US008229336B2

(12) United States Patent
Ono et al.

(10) Patent No.: US 8,229,336 B2
(45) Date of Patent: Jul. 24, 2012

(54) ENDLESS BELT, CARTRIDGE, AND IMAGE FORMING APPARATUS

(75) Inventors: Masato Ono, Kanagawa (JP); Nobuyuki Ichizawa, Kanagawa (JP); Hideaki Kakyo, Kanagawa (JP); Yousuke Tsutsumi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 340 days.

(21) Appl. No.: 12/614,064

(22) Filed: Nov. 6, 2009

(65) Prior Publication Data

US 2010/0247171 A1 Sep. 30, 2010

(30) Foreign Application Priority Data

Mar. 24, 2009 (JP) ..... 2009-072219
Jun. 25, 2009 (JP) ..... 2009-151207

(51) Int. Cl.
*G03G 15/01* (2006.01)

(52) U.S. Cl. ..... 399/302; 399/162; 428/323

(58) Field of Classification Search ..... 399/162, 399/176, 279, 286, 302, 303, 308, 313, 329, 399/330, 331, 357; 492/53, 56, 59; 198/844.1; 428/64.1, 64.2, 64.4, 206, 323
See application file for complete search history.

(56) References Cited

U.S. PATENT DOCUMENTS 4,409,852 A * 10/1983 Suzuki et al. ..... 73/862.392
5,464,716 A * 11/1995 Yashiki ..... 430/41
5,643,686 A * 7/1997 Isshiki et al. ..... 428/839.3
5,758,215 A * 5/1998 Saito et al. ..... 396/311
6,408,146 B1 * 6/2002 Nagano ..... 399/67
6,579,634 B2 * 6/2003 Saito ..... 428/845.5
7,270,925 B2 * 9/2007 Kamoshida et al. ..... 430/58.05
7,308,213 B2 * 12/2007 Sudo et al. ..... 399/51
7,781,078 B2 * 8/2010 van de Veerdonk et al. .. 428/826
2006/0002748 A1 * 1/2006 Kudo et al. ..... 399/302
2008/0047157 A1 2/2008 Takayama et al.
2008/0107854 A1 * 5/2008 Ito et al. ..... 428/41.8
2009/0239016 A1 * 9/2009 Derimiggio ..... 428/36.9
2010/0239332 A1 * 9/2010 Suzuki ..... 399/302
2010/0239764 A1 * 9/2010 Ichizawa et al. ..... 427/336

FOREIGN PATENT DOCUMENTS

JP 06238945 A * 8/1994
JP A-6-222633 8/1994
JP 09260817 A * 10/1997
JP A-11-184278 7/1999
JP A-2003-114558 4/2003
JP A-2005-215440 8/2005
JP A-2008-51801 3/2008

* cited by examiner

*Primary Examiner* — Robert Beatty
(74) *Attorney, Agent, or Firm* — Oliff & Berridge, PLC

(57) ABSTRACT

The invention provides an annular body having a resin layer. The resin layer has a resin and particles. The particles are at least one of conductive or magnetic. A surface of the resin layer has a first region and a second region. The first region is different from the second region in at least one of the surface resistivity or the magnetic flux density. The second region has a resin region and a high density region. The resin region is provided at an outer side with respect to the high density region in the thickness direction of the resin layer and is substantially free of the particle. The high density region has a higher content of the particles comparing to the resin region and the first region. The invention further provides a cartridge having the annular body. The invention further provides an image forming apparatus having the annular body.

13 Claims, 10 Drawing Sheets

ENDLESS BELT, CARTRIDGE, AND IMAGE FORMING APPARATUS

CROSS-REFERENCE TO RELATED APPLICATION

This application is based on and claims priority under 35 USC 119 from Japanese Patent Application No. 2009-72219 filed on Mar. 24, 2009 and Japanese Patent Application No. 2009-151207 filed on Jun. 25, 2009.

BACKGROUND

1. Technical Field

The present invention relates to an annular body, a cartridge, and an image forming apparatus.

2. Related Art

An annular body, which is a member having a circular shape, is used in electrophotographic devices such as electrophotographic image forming devices in many cases. Examples of the annular bodies include an image holding unit, a charging roll as a charging member, a developing roll as a developing device, a transfer belt, a transfer roll as a transfer device, and a fixing roll as a fixing device.

SUMMARY

The invention provides an annular body comprising a resin layer, the resin layer comprising a resin and particles, the particles being at least one of conductive or magnetic, a surface of the resin layer comprising a first region and a second region, the first region being different from the second region in at least one of surface resistivity or magnetic flux density, the second region comprising a resin region and a high density region, the resin region being provided at an outer side with respect to the high density region in the thickness direction of the resin layer and being substantially free of the particles, and the high density region having a higher content of the particles compared to the resin region and the first region.

BRIEF DESCRIPTION OF THE DRAWINGS

Exemplary embodiments of the invention will be described in detail based on the following figures, wherein.

DETAILED DESCRIPTION

Hereinafter, preferred exemplary embodiments of the present invention will be described in detail will be detailed with reference to the drawings.

First Exemplary Embodiment

Figure 1:
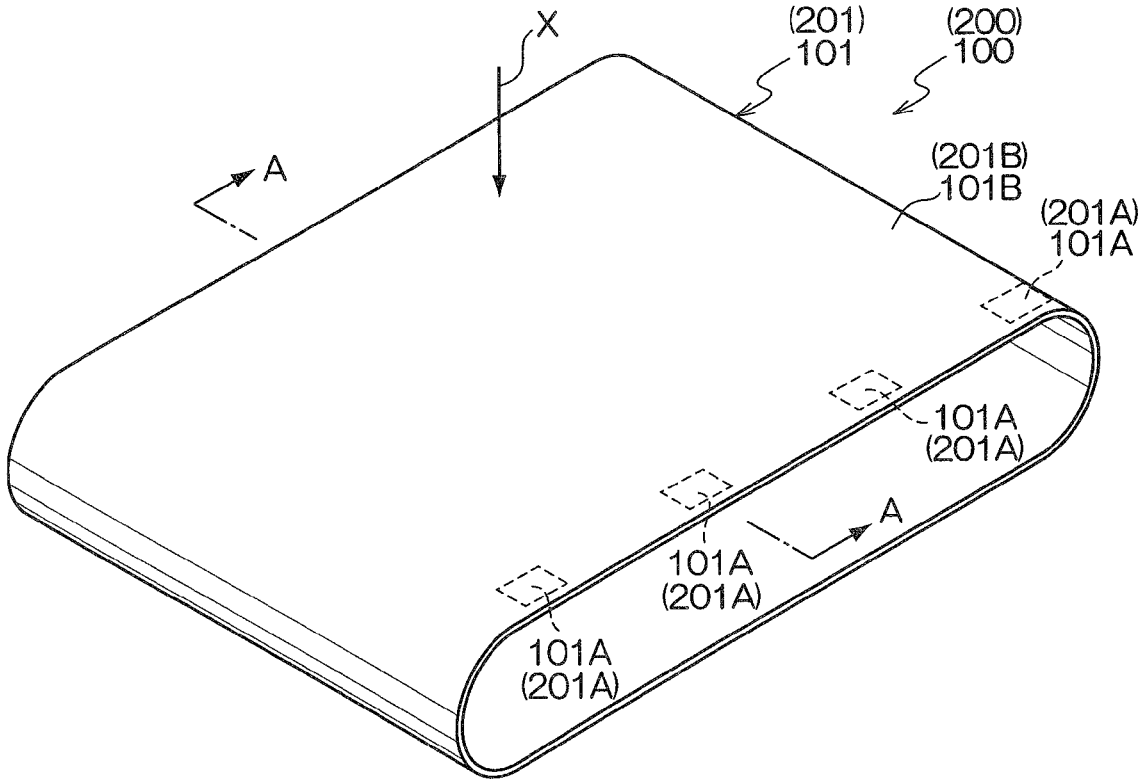
FIG. 1 is a schematic perspective view illustrating an example of an endless belt according to one exemplary embodiment of the invention.
Figure 2:
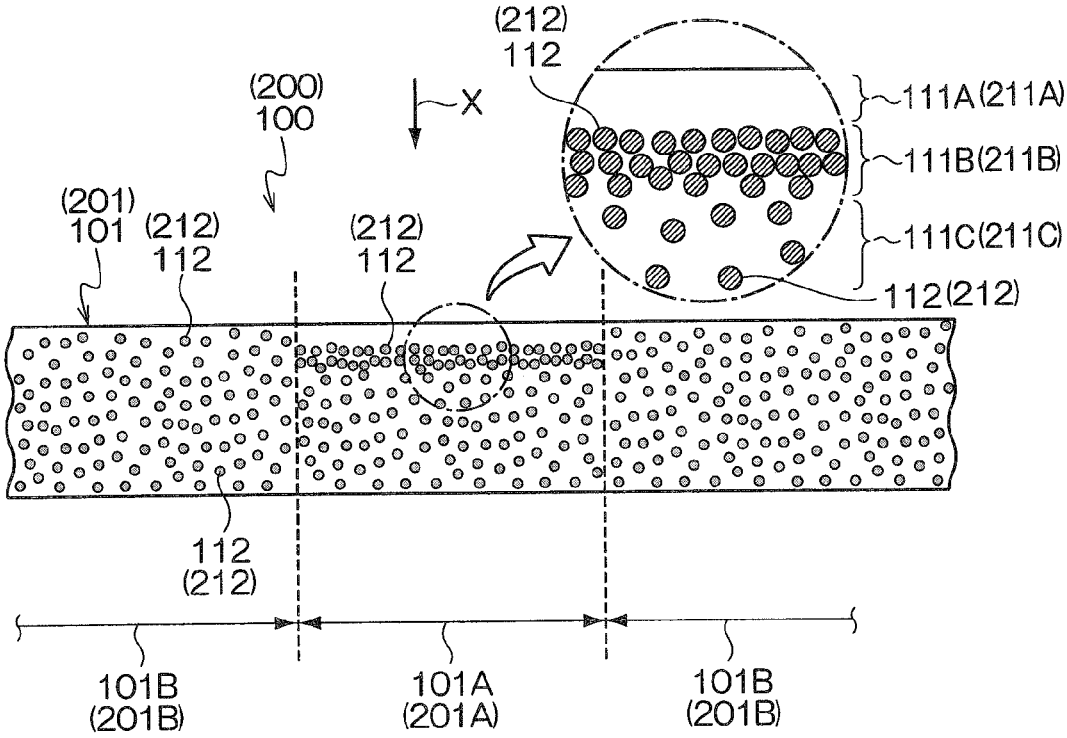
FIG. 2 is a schematic sectional view illustrating the example shown in FIG. 1 sectioned at the A-A plane.

An endless belt 100 according to this exemplary embodiment is an annular body formed to have an endless form as illustrated in FIGS. 1 and 2. The endless belt 100 of this exemplary embodiment corresponds to one exemplary embodiment of an annular body of the present invention.

The endless belt 100 has a resin layer 101 which contains a resin and conductive particles 112.

The resin layer 101 includes two areas at a surface thereof which differ in surface resistivity. Specifically, the surface of the resin layer 101 has a first area (hereinafter referred to as a non-detection region 101B) and a second area having a surface resistivity lower than that of the non-detection region 101B (hereinafter referred to as a detection region 101A).

In the endless belt 100, the surface resistivity of the detection region 101A and the surface resistivity of the non-detection region 101B are different from each other. Therefore, the detection region 101A and the non-detection region 101B are easily detected by measuring the surface resistivity of the endless belt 100. Thus, the detection region 101A is used to detect a position of a measured portion in the endless belt 100.

A difference between the common logarithm value (Log Ω/□) of the surface resistivity of the detection region 101A and the common logarithm value (Log Ω/□) of the surface resistivity of the non-detection region 101B is preferably from about 1.0 to about 10.0, and more preferably from about 3.0 to about 6.0.

When the difference in the common logarithm value of surface resistivity between the detection region 101A and the non-detection region 101B is in the above range, the detection region 101A may be substantially accurately detected by the measurement of the surface resistivity of the endless belt 100.

In contrast, when the difference between the common logarithm value (Log Ω/□) of the surface resistivity of the detection region 101A and the common logarithm value (Log Ω/□) of the surface resistivity of the non-detection region 101B is lower than about 1.0, a slight variation in the resistance of the endless belt 100 may be detected as a difference between the detection and non-detection regions, which may reduce detection accuracy. When the difference exceeds about 10.0, the surface resistivity may be outside the measurable range of the measuring device for measuring the surface resistivity.

As illustrated in FIG. 2, the detection region 101A has a resin region 111A, a high density region 111B, and a rear surface region 111C which are positioned in this order in the thickness direction from the top surface in the thickness direction.

The "surface (of the endless belt 100)" referred in this exemplary embodiment means the surface which is to be subjected to measurement of surface resistivity by a detecting device (explained below). The "top surface" means an area of the outermost side of the resin layer 101.

When the surface resistivity is measured from the inner peripheral surface of the endless belt 100 by the detecting device, the "surface" refers to the inner peripheral surface of the endless belt 100. When the surface resistivity is measured from the outer peripheral surface of the endless belt 100 by the detecting device, the "surface" refers to the outer peripheral surface of the endless belt 100. Herein, explanation of this exemplary embodiment is made defining the "surface" as the peripheral outer surface of the endless belt 100.

The resin region 111A is an area where substantially no conductive particles 112 are present, i.e., an area where only a resin is present. The high density region 111B is an area where the density of the conductive particles 112 is higher than that of the resin region 111A and that of the rear surface region 111C, which are independent areas respectively provided along the thickness direction of the detection region 101A, and also higher than that of the non-detection region 101B. Therefore, the high density region 111B is a high conductive area, the conductivity of which is higher than that of the resin region 111A and that of the rear surface region 111C, which are areas other than the high density region 111B in the detection region 101A, and higher than that of the non-detection region 101B.

In this exemplary embodiment, the resin layer 101 of the endless belt 100 has the detection region 101A and the non-detection region 101B, which reside in the surface of the resin layer 101 and are differed in the surface resistivity. The detection region 101A has the surface resistivity lower than that of the non-detection region 101B. The detection region 101A has the resin region 111A where substantially no conductive particles 112 is present, the high density region 111B, and the rear surface region 111C, which are present in this order from the top surface along the thickness direction.

The detection region 101A is provided in the top surface in the thickness direction, and has the resin region 111A where substantially no conductive particles 112 is present and the high density region 111B which is provided at the inner side relative to the resin region 111A in the thickness direction and where the density of the conductive particles 112 is higher than that of the resin region 111A and the non-detection region 101B.

Here, "the inner side in the thickness direction" refers to an inner area in the thickness direction relative to the detection region 101A provided on the top surface, and is not limited to the inside in the thickness direction of the endless belt 100 and may be the surface (bottom surface) opposite to the top surface.

The detection region 101A of the endless belt 100 of this exemplary embodiment is integrally provided in the endless belt 100.

The thickness of the resin region 111A is preferably from about 0.5 μm to about 3 μm from the viewpoint of obtaining a surface smoothing function, suppressing changes in the surface resistivity of the detection region 101A due to wearing and the like.

The resin region 111A and the high density region 111B may be provided in an area which ranges from the top surface of the detection region 101A to a depth of about 15 μm in the thickness direction. The conductivity of the high density region 111B is preferably about 5 or more times, more preferably from about 5 times to about 100 times, and still more preferably about 5 times to about 50 times as much as the conductivity of the rear surface region 111C disposed at a distance of more than about 15 μm (preferably about 10 μm) in the thickness direction from the top surface of the detection region 101A.

Namely, the highest current value flowing in the area which ranges from the top surface of the detection region 101A to a depth of about 15 μm in the thickness direction (i.e., the highest current value flowing in the high density region 111B) is higher than the highest current value flowing in an area from a position at a distance of more than about 15 μm in the thickness direction from the outermost surface to the innermost surface (i.e., the highest current value flowing in the rear surface region 111C). This relationship of the conductivities (highest current values) may lead to a suppression of reduction in the volume resistivity of the detection region 101A relative to the volume resistivity of the non-detection region 101B so that these volume resistivities are approximately the same, and effective reduction of the surface resistivity of the detection region 101A relative to the non-detection region 101B.

When the resin layer 101 is divided into plural portions having the same surface area, the contents of the conductive particles 112 in respective portions (respectively having the volume defined by the divided surface area and the depth of the resin layer 101 in the thickness direction) are the same value. This condition may be achieved by using the production method described below. Due to this condition, the surface resistivity of the detection region 101A and that of the non-detection region 101B are same, and the volume resistivity of the detection region 101A and that of the non-detection region 101B are different. This property may be effectively developed by giving the relationship of the conductivities (the highest current values).

In this exemplary embodiment, the expression of "contents of one material in objects are the same value" and "same content" refer to that a content(/contents) of the material in one of the object(/respective objects) is(/are respectively) in the range of from about 95% to about 105% of an average value calculated from the contents of the material in the objects. Further, in this exemplary embodiment, the expression of "densities of one material in objects are the same value" and "same density" refer to that a density(/densities) of the material in one of the object(/respective objects) is(/are respectively) in the range of from about 95% to about 105% of an average value calculated from the densities of the material in the objects. The definition of the volume resistivity is described below.

Examples of methods for observing the absence or presence of the conductive particles 112 in the resin region 111A, the high density region 111B, and the rear surface region 111C include: a method including producing a cross section piece of the belt (a piece of the endless belt 100) by a focused ion beam (FIB), and then observing the cross section piece with a transmission electron microscope to directly observe the absence or presence of the particles; and a method including producing across section piece of the belt with a microtome, and then obtaining the height information from an atomic force microscope (AFM) to see the absence or presence of the particles.

The conductivity of the 15 μm area from the top surface in the thickness direction, and the area from a position at a distance of more than 15 μm from the top surface in the thickness direction to the depth equal to or more than the thickness, may be compared by producing a cross section piece of the belt with a microtome, and subjecting the cross section piece to the AFM observation in a conducting mode.

Specific examples of measurement methods therefor include a method including measuring the highest current value in each area when observing the cross section piece (sample) of the belt of 10 μm square using D3000 and NANOSCOPE III (both trade names, manufactured by Digital Instruments) under the conditions employing "Contact mode" as a measuring mode and a Au-coated conductive cantilever as a cantilever, and setting a spring constant to 0.2 N/m, and an applied voltage to −5V.

The cross section piece (sample) of the belt is produced by embedding the belt in epoxy resin, and cutting the same with a microtome. A silver paste electrode is adhered to the sample in the direction parallel to the sample depth to obtain a cantilever counter electrode. The cross section piece (sample) of the belt of 10 μm square is observed to obtain current value (conductivity) and height information.

This condition is described for the purpose of showing one exemplary embodiment, and the observation conditions are not limited to this condition. The measurement range, the applied voltage, the spring constant, etc., may be arbitrarily changed according to the cross section piece (sample) of the belt.

The conductivities may be compared based on the highest current value thus obtained.

Although the endless belt 100 in this exemplary embodiment has a configuration provided with a single layer of the resin layer 101, the configuration of the annular body, which is one aspect of the invention, is not limited thereto. In another exemplary embodiment, the annular body, which is one aspect of the invention, may have a configuration in which other functional layers are provided on the outer peripheral surface or inner peripheral surface of the resin layer 101. In this case, the other functional layers are layers that do not change the difference in the surface resistivity between the detection region 101A and the non-detection region 101B in the resin layer 101, or layers which allow detection of the difference by the detecting device even when the surface resistivity is changed by the other functional layers.

Figure 3:
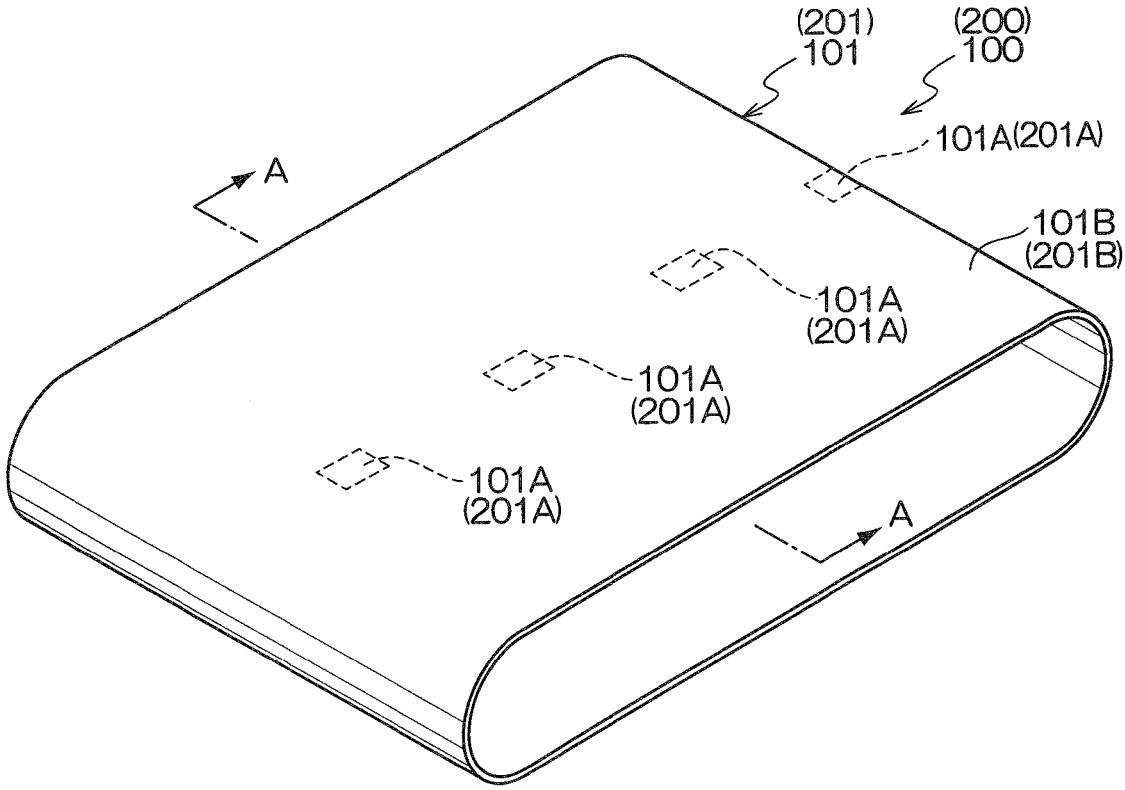
FIG. 3 is a schematic perspective view illustrating another example of an endless belt according to one exemplary embodiment of the invention.

In the exemplary embodiment illustrated in FIG. 1, the detection regions 101A are provided at given intervals along the edge of the endless belt 100. The detection region 101A is not required to be provided in the entire of the surface of the resin layer 101. It is sufficient as long as the detection region 101A is provided in a part(s) of the surface of the resin layer 101. The detection region 101A may be provided at any position of the surface of the resin layer 101. For example, the detection region 101A may be provided at the center in the width direction as illustrated in FIG. 3. Since the detection region 101A is detected by measurement of the surface resistivity, the place at which the detection region 101A is not specified in the surface of the endless belt 100. In contrast to conventional arts in which the position of the detection region is limited to the peripheral edge or the like, the detection region 101A may be formed at any place in the surface of the endless belt 100.

In this exemplary embodiment, plural detection regions 101A are provided in the surface of the endless belt 100. However, it is sufficient as long as at least one detection region 101A is provided. Plural detection regions 101A may not be necessary.

A portion (area) of the detection region 101A revealing on the surface of the endless belt 100 may have any shape insofar as the shape may be easily detected by a cartridge 130 or an image forming apparatus 150 described below. Examples of the shape include a circular shape and a rectangular shape.

Hereinafter, the components and properties of the endless belt 100 according to this embodiment will be described.

The endless belt 100 has a configuration in which the resin layer 101 is formed into an annular shape, i.e., an endless belt.

Resin Material

A resin material, which is a resin contained in the resin layer 101, preferably has the Young's modulus of about 3,500 MPa or more, which is more preferably about 4,000 MPa or more, although the Young's modulus of the resin may vary according to the thickness of the belt. There is no particular limitation to the kind of the resin material as long as the condition of the Young's modulus is satisfied. Examples of the resin include a polyimide resin, a polyamide resin, a polyamide imide resin, a polyether ether ester resin, a polyarylate resin, a polyester resin, and a polyester resin to which a reinforcer is added.

The Young's modulus can be determined based on inclination of a tangent line drawn to the curve of the initial strain area of the stress-strain curve obtained by performing a tensile test according to JIS K7127 (1999), which substantially accords to ISO 527-3 1995, and the disclosure of which is incorporated by reference herein. The measurement can be performed using a rectangular test piece (about 6 mm in width and about 130 mm in length) and a dumbbell No. 1 at a test rate of about 500 mm/m while adjusting the thickness to the thickness of a belt body.

Examples of the resin include a polyimide resin. A polyimide resin, which is a resin having a high Young's modulus, shows little deformation property at the time of driving (stress of a support roll, a cleaning blade, or the like) of a belt formed therefrom. Therefore, the endless belt 100 may be formed to one that hardly causes image defects such as misregistration of color images formed of toner when the resin layer 101 contains a polyimide resin as the resin material.

A polyimide resin can be usually obtained as a polyamide acid solution by polymerization-reacting an equivalent mole of tetracarboxylic acid dianhydride or a derivative thereof and a diamine in a solvent. Examples of tetracarboxylic acid dianhydride include a dianhydride represented by the following Formula (I).

Formula (I)

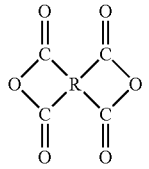

In Formula (I), R is a tetravalent organic group, and is an aromatic group, an aliphatic group, an alicyclic group, a combination of an aromatic group and an aliphatic group, or a substituted group of any one of these.

Specific examples of tetracarboxylic acid dianhydride include pyromellitic acid dianhydride, 3,3',4,4'-benzophenonetetracarboxylic acid dianhydride, 3,3',4,4'-biphenyltetracarboxylic acid dianhydride, 2,3,3',4-biphenyltetracarboxylic acid dianhydride, 2,3,6,7-naphthalenetetracarboxylic acid dianhydride, 1,2,5,6-naphthalenetetracarboxylic acid dianhydride, 1,4,5,8-naphthalenetetracarboxylic acid dianhydride, 2,2'-bis(3,4-dicarboxyphenyl) sulfonic acid dianhydride, perylene-3,4,9,10-tetracarboxylic acid dianhydride, bis(3,4-dicarboxyphenyl)ether dianhydride, and ethylenetetracarboxylic acid dianhydride.

Specific examples of diamine include 4,4'-diaminodiphenyl ether, 4,4'-diaminodiphenylmethane, 3,3'-diaminodiphenylmethane, 3,3'-dichlorobenzidine, 4,4'-diaminodiphenyl sulfide, 3,3'-diaminodiphenylsulfone, 1,5-diaminonaphthalene, m-phenylenediamine, p-phenylenediamine, 3,3'-dimethyl4,4'-biphenyldiamino, benzidine, 3,3'-dimethylbenzidine, 3,3'-dimethoxybenzidine, 4,4'-diaminodiphenylsulfone, 4,4'-diaminodiphenylpropane, 2,4-bis(β-aminotertiarybutyl) toluene, bis (p-β-aminotertiarybutyl phenyl)ether, his (p-β-methyl-δ-aminophenyl) benzene, bis-p-(1,1-dimethyl-5-amino-bentyl) benzene, 1-isopropyl-2,4-m-phenylenediamine, m-xylylenediamine, p-xylylenediamine, di (p-aminocyclohexyl) methane, hexamethylenediamine, heptamethylenediamine, octamethylenediamine, nonamethylenediamine, decamethylenediamine, diaminopropyltetramethylene, 3-methylheptamethylenediamine, 4,4-dimethylheptamethylenediamine, 2,11-diaminododecane, 1,2-bis-3-aminopropoxyethane, 2,2-dimethylpropylenediamine, 3-methoxyhexamethylenediamine, 2,5-dimethylheptamethylenediamine, 3-methylheptamethylenediamine, 5-methylnonamethylenediamine, 2,17-diaminoeicosadecane, 1,4-diaminocyclohexane, 1,10-diamino-1,10-dimethyldecane, 12-diaminooctadecane, 2,2-bis [4-(4-aminophenoxy) phenyl]propane, piperazine, $H_2N(CH_2)_3O(CH_2)_2O(CH_2)NH_2$, $H_2N(CH_2)_3S(CH_2)_3NH_2$, and $H_2N(CH_2)_3N(CH_3)_2(CH_2)_3NH_2$.

Preferable examples of a solvent when tetracarboxylic acid dianhydride and diamine are polymerization-reacted include a polar solvent (organic polar solvent) from a viewpoint of solubility. As a polar solvent, N,N-dialkylamides are preferable, and examples thereof include N,N-dimethylformamide, N,N-dimethylacetamide, N,N-diethylformamide, N,N-diethylacetamide, N,N-dimethylmethoxyacetamide, dimethyl sulfoxide, hexamethylphosphortriamide, N-methyl-2-pyrrolidone, pyridine, tetramethylenesulfone, and dimethyltetramethylenesulfone which have a low molecular weight. These can be used alone or in combination of plurality of them.

The solid content of the polyamic acid solution is preferably from about 5% by weight to about 40% by weight and more preferably from about 10% by weight to about 30% by weight. When the solid content is about 40% by weight or less, the solution may be easily applied and the uniformity of a coating film may be secured. When the solid content is about 5% by weight or more, the film thickness having strength may be easily obtained. Although the viscosity of the polyamic acid solution is not particularly limited, the solution having a viscosity of from about 1 Pa·s to about 500 Pa·s may be easily handled in general.

Conductive Particle

Conductive particle 112 is contained in the resin layer 101. Conductive- or semiconductive-fine powers may be used as the conductive particle. There is no particular limitation on electrical conductivity of the conductive particle as long as it facilitates stably providing a desired electrical resistance to the belt. Examples of the conductive particle include: carbon black such as Ketjenblack, acetylene black, or oxidation-treated carbon black having a pH of 5 or lower; metals such as aluminum or nickel; metal oxide compounds such as a tin oxide; and potassium titanate. These substances may be used singly or in combination, and carbon black is preferable in view of its advantage in price. The "conductive" used herein means that the volume resistivity is lower than about $10^7$ Ωcm. Further, the "semiconductive" means that the volume resistivity is from about $10^7$ to about $10^{13}$ Ωcm. The same meanings are applied thereto in the following description.

Two or more kinds of carbon blacks may be used in combination. Carbon blacks which are used in combination are preferably different from each other in conductivity. For example, a combination of carbon blacks which are different in physical properties such as a degree of oxidation treatment, a DBP oil absorption amount, or a specific surface area by BET method utilizing nitrogen adsorption (a method of calculating the surface area per g from the amount of adsorbed nitrogen), can be used. Here, the DBP oil absorption amount (ml/100 g) denotes the amount of dibutyl phthalate (DBP) which can be absorbed by 100 g of carbon black and is a value defined by ASTM (U.S. standard test method) D2414-6TT. The BET method is defined by JIS K6217, the disclosure of which is incorporated by reference herein.

When two or more kinds of carbon blacks having different electrical conductivities are used in combination in the belt, a surface resistivity of the belt can be adjusted by adding carbon black manifesting high electric conductivity is added in advance and then adding carbon black having a low electric conductivity. When two or more kinds of carbon blacks are contained in the belt, mixing and dispersing of both carbon blacks can be enhanced by using acidic carbon black as at least one kind of them.

The method for producing the endless belt 100 constituted by the resin layer 101 according to this exemplary embodiment will be described. FIGS. 4A to 4D are flow charts illustrating the method for producing the endless belt 100 according to this exemplary embodiment.

Figure 4A:
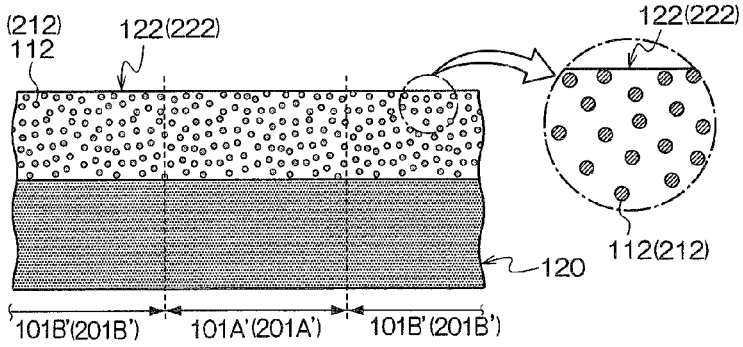
FIGS. 4A to 4D are diagrams illustrating an example of a method for producing the endless belt according to one exemplary embodiment of the invention.

In the method for producing the endless belt 100 according to this exemplary embodiment, a coating liquid containing the conductive particles 112, a resin material, and a solvent is prepared first. Then, as illustrated in FIG. 4A, the coating liquid is applied to a cylindrical metal mold 120 to obtain a coating film 122 formed from the coating liquid.

There is no particular limitation a method for applying the coating liquid to the cylindrical metal mold 120 to form the coating film 122 having an endless shape. Examples of the application method include: immersing an external circumferential surface of a cylindrical mold in the solution; coating the solution on an internal circumferential surface of a cylindrical mold and may further centrifuging the mold; and filling the solution into an injection mold. The mold may be treated to be releasable in advance of the formation of the endless belt.

An examplary embodiment of a method of producing the polyamide acid solution, in which carbon black (the conductive particle 112) is dispersed, will be described below, although the method is not limited thereto.

First, purified carbon black is prepared and subjected to dispersing in an organic polar solvent. The dispersing may be preferably a method including dispersing carbon black with a disperser or a homogenizer after preliminary stirring is performed. In addition, the dispersing may be preferably a media-free dispersion method using no media, since contamination with fine media may reduce purification effect of carbon black, as is similar to the refining of carbon black. Particularly preferable examples of the media-free dispersion method include a method including utilization of a jet mill since it is capable of dispersing a high viscosity solution while suppressing unevenness in dispersing degree of carbon black.

The diamine component and the acid anhydride component are dissolved in the thus-obtained carbon black dispersion, and polymerization is performed to prepare a polyamide acid solution in which carbon black is dispersed.

The concentrations of monomers to be dissolved in the carbon black dispersion (namely, the concentration of the diamine component and the concentration of the acid anhydride component in a solvent) can be respectively determined depending on various conditions, and are respectively preferably from about 5% by weight to about 30% by weight. Further, the polymerization reaction temperature can be adjusted to preferably about 80° C. or lower, and particularly preferably from about 5° C. to about 50° C. The reaction time is from about 5 hours to about 10 hours.

Since the polyamide acid solution in which carbon black is dispersed is a high viscosity solution, an air bubble is generated during preparation of the solution is not naturally removed therefrom, and defects such as projection, recess or a hole due to an air bubble may occur upon coating of the solution for forming the belt. In consideration of this, the polyamide acid solution is desirably subjected to defoaming. It is preferable that the coating of the polyamide acid solution is performed as soon as possible upon the defoaming.

Next, the coating film 122 applied to the cylindrical metal mold 120 is dried. The drying may be carried out so that a content ratio of the solvent remaining in the coating film 122 is about 25% or less, preferably about 20% or less, and still more preferably about 15% or less. When the content ratio of the solvent remaining in the coating film 122 is excessive, uneven distribution (density increasing) of the conductive particles 112 may be difficult to occur at the inner side in the thickness direction of the region defined as the detection region 101A. In contrast, when the content ratio of the solvent remaining in the coating film 122 is smaller, uneven distribution (density increasing) of the conductive particles 112 may be likely to occur. By regulating the content ratio of the solvent remaining in the coating film 122, i.e., by regulating the drying state of the coating film 122, A degree of uneven distribution (density) of the conductive particles 112 in the detection region 101A may be regulated, and the position in the thickness direction of the area (high density region 111B), in which the conductive particles 112 are localized may also be regulated, in the detection region 101A of the endless belt 100 to be obtained.

Here, the "content ratio of the solvent remaining in the coating film 122 (, that is herein also referred to as the content ratio of the remaining solvent)" is expressed in terms of a proportion of a weight of the solvent remaining in the coating film after drying with respect to a weight of the solvent contained in the coating film before drying. The content ratio of the remaining solvent may be determined as follows.

For example, when the amount of the solid content of the resin material (dry weight of the resin material) and that of the conductive particle are known, the total amount of the coating film before the drying is accurately weighed, and then the amount of the solvent included in the total amount of the coating film is calculated. Thereafter, the total amount of the coating film after the drying is accurately weighed. A difference between the total amount of the coating film before the drying and the total amount of the coating film after the drying (reduction amount) is defined as the amount of the lost solvent. The content ratio of the remaining solvent is determined by calculating: [(the total amount of the coating film after the drying)−(the amount of the solid content of the resin material)−(the amount of the conductive particle)]/[(the total amount of the coating film before the drying)−(the amount of the solid content of the resin material)−(the amount of the conductive particle)].

The content ratio of the remaining solvent may be alternatively determined using a thermal extraction gas chromatography mass spectroscopy. An exemplary embodiment of this measurement will be described below. In the exemplary embodiment, about 2 mg or more to about 3 mg or less of the coating film after the drying is cut out to obtain a sample. Then, the sample is weighed, placed in a heat extractor (trade name: PY2020D, manufactured by Frontier Laboratories, Ltd.), and heated to 400° C. Volatilized components are injected into a gas chromatogram mass spectrometer (trade name: GCMS-QP2010, manufactured by Shimadzu Corp.) through a 320° C. interface, and then quantified. More specifically, the volatilized component is injected into the gas chromatogram mass spectrometer using helium gas as a carrier gas in an amount of 1/51 of the component volatilized from the sample (split ratio of 50:1) in a column having an inner diameter of 0.25 μm×30 m (trade name: CAPILLARY COLUMN UA-5, manufactured by Frontier Laboratories, Ltd.) at a linear velocity of 153.8 cm (a carrier gas flow rate at a column temperature of 50° C. of 1.50 ml/minute and a pressure of 50 kPa). Subsequently, the column is held at 50° C. for 3 minutes, the temperature of the column is raised to 400° C. at a rate of 8° C./min, and then the column is held at the same temperature for 10 minutes so as to desorb the volatilized component. Further, the volatilized component is injected into a mass spectrometer at an interface temperature of 320° C. to find a peak corresponding to the solvent in a chromatogram obtained by the gas chromatography, and the area of the peak is determined. A calibration curve which is prepared in advance using known amounts of the same solvent is used to quantify the amount of the solvent corresponding to the peak. The amount of the solvent thus quantified is divided by "(the total amount of the coating film before the drying)−(the amount of the solid content of the resin material)−(the amount of the conductive particle)", which corresponds to the total amount of the solvent in the coating film before the drying, to determine the amount of the remaining solvent.

The exemplary embodiment of the measurement is described for the purpose of showing one exemplary embodiment, and the measurement conditions are not limited thereto. The measurement conditions may be changed according to decomposition behavior of the resin to be used, temperature changes of the resin to be used, the boiling point of the solvent to be used and the like.

Figure 4B:
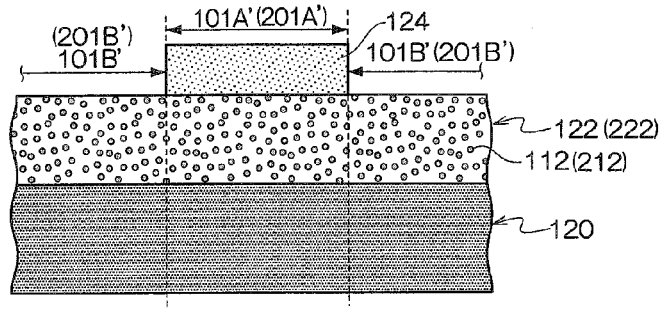

Next, as illustrated in FIG. 4B, an elution solvent 124 for eluting the resin material is applied only to a target region 101A', which is to be made into the detection region 101A, in the surface of the dried coating film 122. More specifically, the elution solvent 124 is applied only to the target region 101A', which is to be made into the detection region 101A among all the areas in the surface of the coating film 122, and the elution solvent 124 is not applied to regions other than the target region 101A' (regions 101B' in FIGS. 4A to 4C).

Examples of methods for applying the elution solvent 124 only to the target region 101A' include a method including masking the region 101B', which is other than the target region 101A', on the surface of the dried coating film 122 by providing a sheet (not illustrated) insoluble in the elution solvent 124 so that only the target region 101A' is exposed to the open air. Here, the elution solvent 124 may be applied only to the target region 101A' as a result by applying the elution solvent 124 to the entire of the sheet. The sheet is removed after the detection region 101A is formed.

In the target region 101A' to which the elution solvent 124 has been applied, the elution solvent 124 permeates in the dried coating film 122. Therefore, in the coating film 122, the region adjacent to the interface with the permeating elution solvent 124 is swollen with the elution solvent 124. In this case, the amount of the solvent which is present in the elution solvent 124 adjacent to the interface is larger than the amount of the solvent which is present in a portion which is a part of the coating film 122 and is adjacent to the interface with the elution solvent 124 (namely, the former has a high solvent concentration than latter). Therefore, the resin material contained in the permeating solution in the portion which is a part of the coating film 122 and is adjacent to the interface with the elution solvent 124 is easily eluted into the side of the elution solvent 124.

Figure 4C:
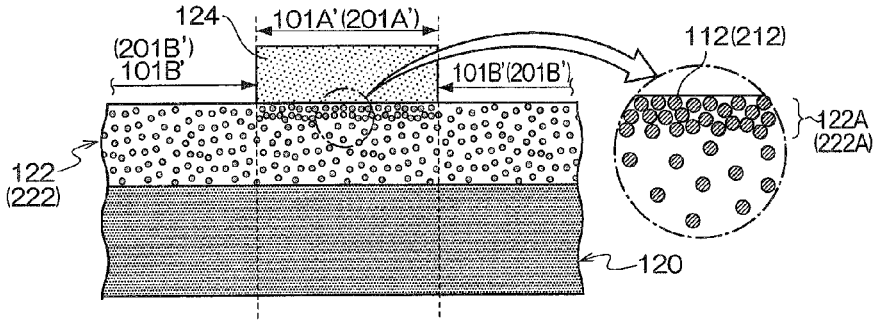

As illustrated in FIG. 4C, the conductive particles 112 are not eluted in the elution solvent 124. Accordingly, when the resin material is eluted into the side of the elution solvent 124, the density of the conductive particles 112 in the target region 101A' where the resin material has been eluted out increases as compared with the other regions which reside in the thickness direction of the target region 101A' according to the elution of the resin material. As a result, a localization region 122A, in which the conductive particles 112 are localized, is formed on the surface of the target region 101A' (a region adjacent to the interface with the elution solvent 124).

The elution solvent 124 is a solvent for eluting the resin material. Therefore, the elution solvent is selected from solvents that dissolve the resin material. Here, the description "solvent that dissolves resin materials" means that the solid content of a dissolved resin based on the total amount of the solvent at 25° C. is about 10% by weight or more.

The elution solvent may be preferably the same solvent as that used in the coating liquid. Examples of the elution solvent employed when the coating liquid is a polyamide acid solution include a polar solvent. As a polar solvent, N,N-dialkylamides are preferable, and examples thereof include N,N-dimethylformamide, N,N-dimethylacetamide, N,N-diethylformamide, N,N-diethylacetamide, N,N-dimethylmethoxyacetamide, dimethyl sulfoxide, hexamethylphosphortriamide, N-methyl-2-pyrrolidone, pyridine, tetramethylenesulfone, and di methyltetramethylenesulfone which have a low molecular weight. These can be used alone or in combination of plurality of them.

The application amount of the elution solvent 124 may be typically from about 0.001 g/cm$^2$ to about 1 g/cm$^2$, preferably from about 0.01 g/cm$^2$ to about 1 g/cm$^2$, and more preferably from about 0.01 g/cm$^2$ to about 0.5 g/cm$^2$.

The surface resistivity of the detection region 101A may be adjusted by adjusting the application amount of the elution solvent 124 and/or the application time of the elution solvent 124.

Figure 4D:
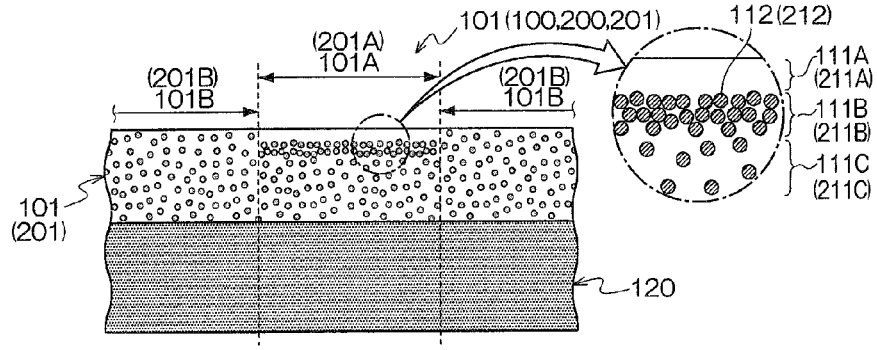

Next, as illustrated in FIG. 4D, the elution solvent 124 applied to the target region 101A' of the coating film 122 is dried. The drying may be carried out so that, for example, the content ratio of the remaining solvent is about 10% or lower. The content ratio of the remaining solvent may be determined based on the kind of the resin material to be used, application purpose of the endless belt 100 to be obtained, strength of the endless belt 100 to be obtained, maintenance properties of the endless belt 100 to be obtained, or the like.

The elution solvent 124 applied to the coating film 122 contains eluted resin material. Therefore, the resin material precipitates by drying the elution solvent 124. The precipitated resin material forms a laminar structure on the localization region 122A in which the conductive particles 112 are localized. In this case, the applied elution solvent 124 does not contain the conductive particles 112. Therefore, the resin region 111A, which does not contain the conductive particles 112, is formed on the localization region 122A, in which the conductive particles 112 are localized.

As a result, the detection region 101A, in which the resin region 111A, the high density region 111B, and the rear surface region 111C are provided in this order from the surface, is produced. The resin region 111A basically does not contain the conductive particles 112, although a few conductive particles 112 may move to the applied elution solvent 124 to be contained in the resin region 111A due to the production method.

In the region 101B', to which the elution solvent 124 has not been applied, the dispersion state of the conductive particles 112 in the state where the coating film 122 is dried as shown in FIG. 4A is maintained.

The endless belt 100 containing the resin layer 101 having the detection region 101A and the non-detection region 101B, which are two areas different in the surface resistivity in the surface of the endless belt 100, may be produced through the above process.

The endless belt 100 having the resin layer 101 obtained by the process described above has two areas different in the surface resistivity in the plane direction of the detection region 101A (having a surface resistivity lower than that of the non-detection region 101B) and the non-detection region 101B. The detection region 101A has the resin region 111A where the conductive particles 112 are not present, the high density region 111B, and the rear surface region 111C in this order from the top surface in the thickness direction. The high density region 111B is an area where the density of the conductive particles 112 is higher than that of the resin region 111A, the rear surface region 111C, and the non-detection region 101B.

The resin layer 101 may be produced by this production method. Thus, when the resin layer 101 is divided into plural portions having the same surface area, the contents of the conductive particles 112 in respective portions are approximately the same value. Therefore, the resin layer 101 in which the volume resistivity is constant along the circumferential direction may be produced.

The description "the volume resistivity is constant", specifically means that the common logarithm value of volume resistivity of each region in the surface of the endless belt 100 is a value of about ±0.5 or lower and preferably a value of about ±0.3 or lower to the average value calculated from the common logarithm values of volume resistivity of all the regions in the surface of the endless belt 100 (the resin layer 101) produced by the production method.

The value of "±0.5 or lower" is within the range of slight variations in resistance generally present in various conductive or semi-conductive annular members used in electrophotographic image forming devices.

On the other hand, the detection region 101A and the non-detection region 101B, which are two kinds of regions which are different in the surface resistivity, are formed in the surface of the resin layer 101.

When a resin precursor such as a polyamide acid solution is used to form a polyimide resin as the resin material, the endless belt 100 may be produced by performing sintering after the drying of the elution solvent 124. The sintering (namely, the conversion of polyamide acid to imide) is generally performed by subjecting the polyamide acid to high temperature of about 200° C. or more. The conversion may not be sufficiently achieved when the temperature is lower than about 200° C. Although the conversion with high temperature can be advantageous for imide conversion to obtain stable properties, thermal efficiency of the conversion with high temperature may be inferior and high cost may be required due to the use of thermal energy. Thus, the heating temperature for the conversion may be determined in view of properties and productivity of the endless belt.

Cartridge

Figure 5:
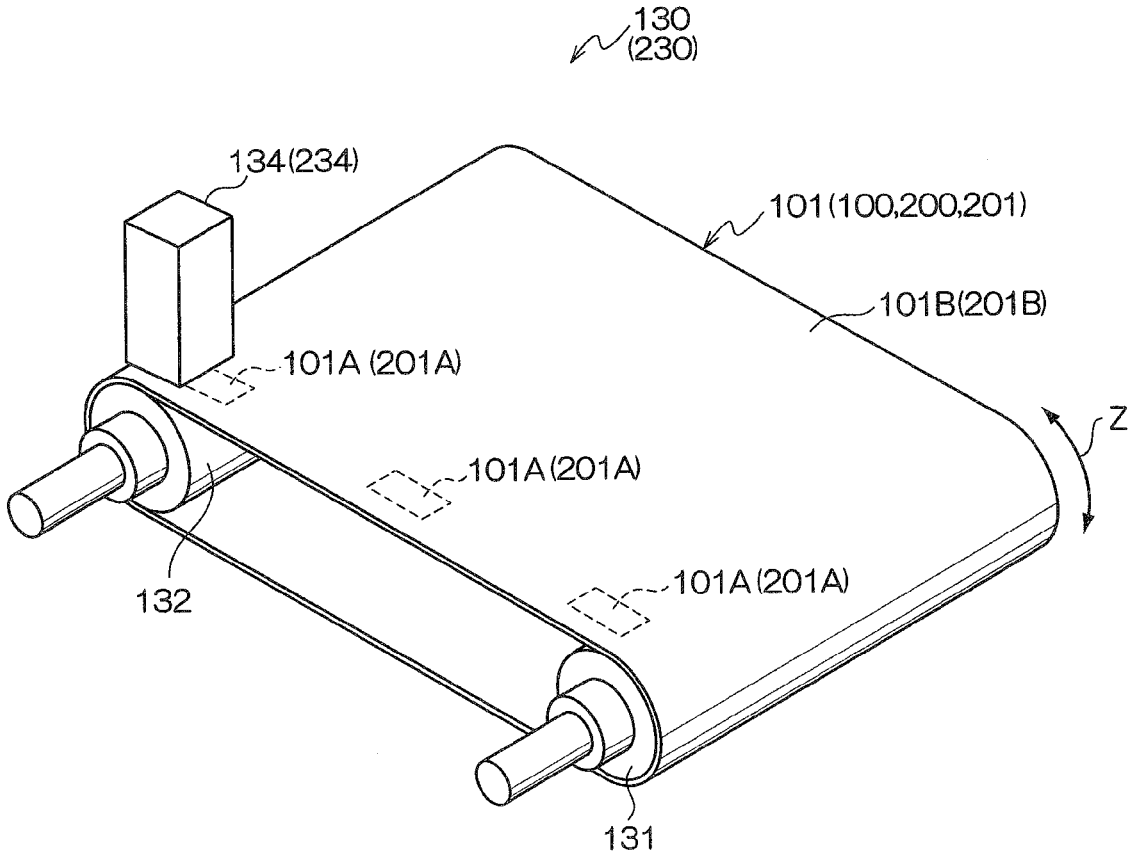
FIG. 5 is a schematic perspective view illustrating an example of a cartridge according to one exemplary embodiment of the invention.

FIG. 5 is a schematic perspective view illustrating a cartridge according to one exemplary embodiment.

A cartridge 130 according to this exemplary embodiment contains the endless belt 100 according to this exemplary embodiment, a detecting device 134, and a follower roll 131 and a driving roll 132 as support units as illustrated in FIG. 5.

The endless belt 100 is held under tension by the follower roll 131 and the driving roll 132 that are disposed facing with each other (hereinafter sometimes referred to as "tensioned"). Then, the driving roll 132 is rotated in the circumferential direction by actuation of a driving unit (not illustrated), and then the follower roll 131 is rotated in the circumferential direction following the rotation of the driving roll 132. Thus, the endless belt 100 tensioned by the follower roll 131 and the driving roll 132 is rotated in the circumferential direction (direction indicated by the arrow Z in FIG. 5).

The detecting device 134 is a device for detecting the detection region 101A provided in the resin layer 101 of the endless belt 100, and is provided at a position at which the detecting device 134 can detect the detection region 101A.

In this exemplary embodiment, the detection region 101A is provided so that the surface of the detection region 101A resides in the outer peripheral surface of the endless belt 100. Namely, the detection region 101A is provided so as to be disposed on the outer peripheral surface of the endless belt 100.

Therefore, the detecting device 134 is provided at a position where the detection regions 101A rotating with the rotation of the endless belt 100 can be successively detected when the endless belt 100 is rotated in the circumferential direction by the rotation of the follower roll 131 and the driving roll 132 (direction indicated by the arrow Z in FIG. 5). Specifically, when the detection region 101A is provided at the end in the axial direction of the endless belt 100 as illustrated in FIG. 5, the detecting device 134 may be provided at a position corresponding to the end in the axial direction. When the detection region 101A is provided at the center in the axial direction of the endless belt 100 as illustrated in FIG. 3, the detecting device 134 (not shown) may be provided at a position corresponding to the center in the axial direction.

Figure 6:
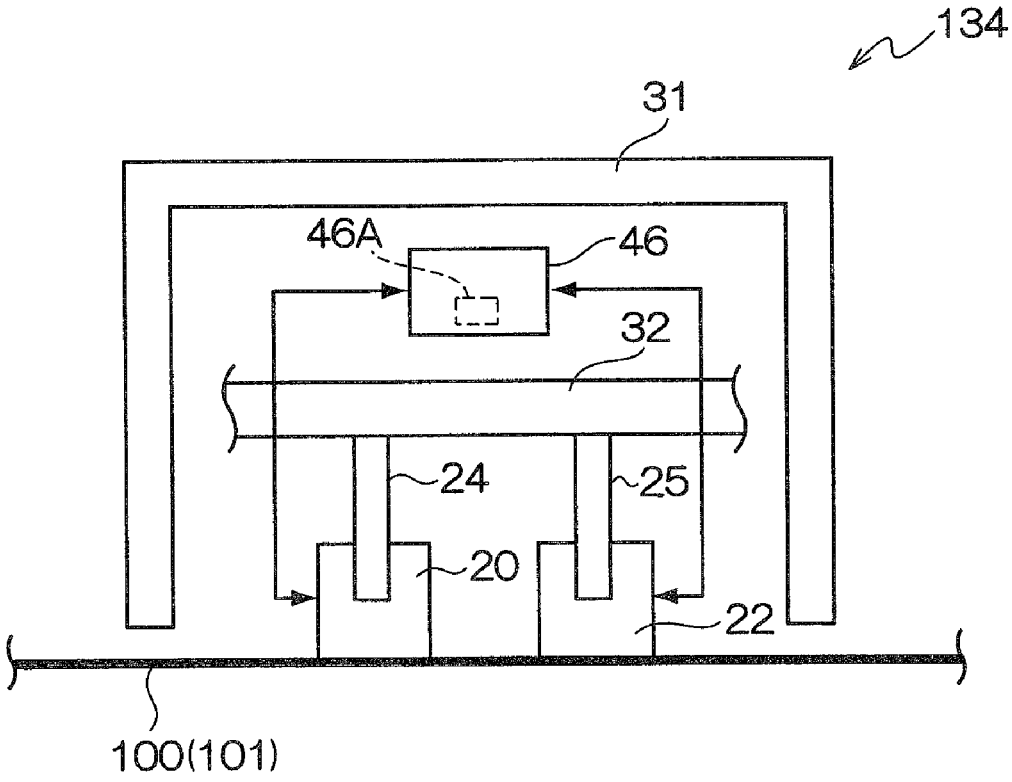
FIG. 6 is a schematic diagram illustrating a detecting device.

The detecting device 134 has a surface resistivity measurement unit 46 and a pair of rotating electrodes 20 and 22 in a housing 31 having an opening bottom as illustrated in FIG. 6. The pair of rotating electrodes 20 and 22 are formed into a cylindrical shape, and are disposed at given intervals so that the outer peripheral surface of each electrode is in contact with the outer peripheral surface of the endless belt 100. In this exemplary embodiment, the rotating electrodes 20 and 22 are disposed at intervals in the axial direction of the endless belt 100. However, the arrangement of the rotating electrodes 20 and 22 is not limited thereto. The rotating electrodes 20 and 22 may be disposed at intervals in the circumferential direction of the endless belt 100 according to the shape of the detection region 101A to be measured, position where the detection region 101A is disposed, dimension thereof, and the like.

The rotating electrode 20 is supported by a rotating electrode-supporting unit 32 through a holder 24. The rotating electrode 22 is supported by the rotating electrode-supporting unit 32 through a holder 25. The rotating electrodes 20 and 22 are cylindrical, and are provided so that the outer peripheral surface is in contact with the outer peripheral surface of the endless belt 100. The rotating electrodes 20 and 22 are supported by the holders 24 and 25, respectively, in such a manner as to rotate in the same direction as the rotation direction of the endless belt 100.

Figure 7A:
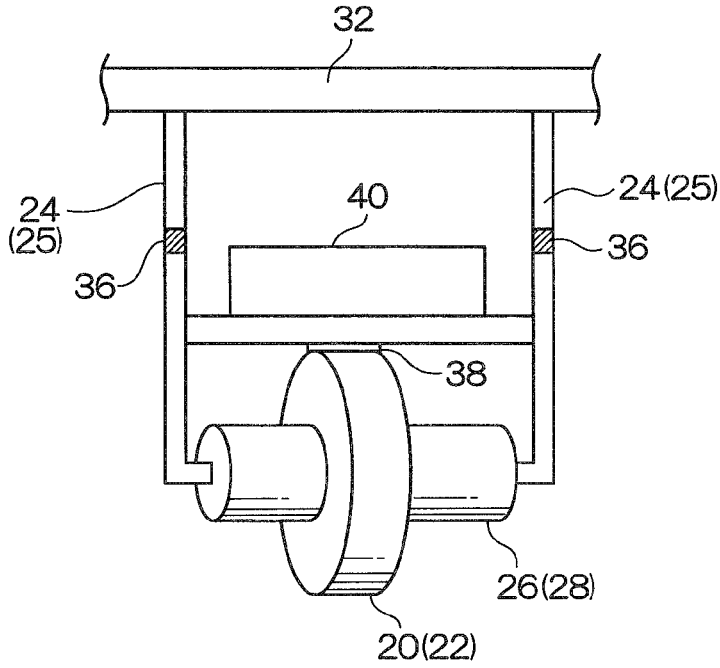
FIGS. 7A and 7B are exploded schematic diagrams illustrating a rotating electrode and a portion near the rotating electrode in the detecting device.

As illustrated in FIG. 7A, the rotating electrode 20 is cylindrical and is connected to the holder 24 through a shaft member 26. Similarly to the rotating electrode 20, the rotating electrode 22 is also cylindrical and connected to the holder 25 through a shaft member 28. Each of the holders 24 and 25 has a vibrator 36.

Figure 7B:
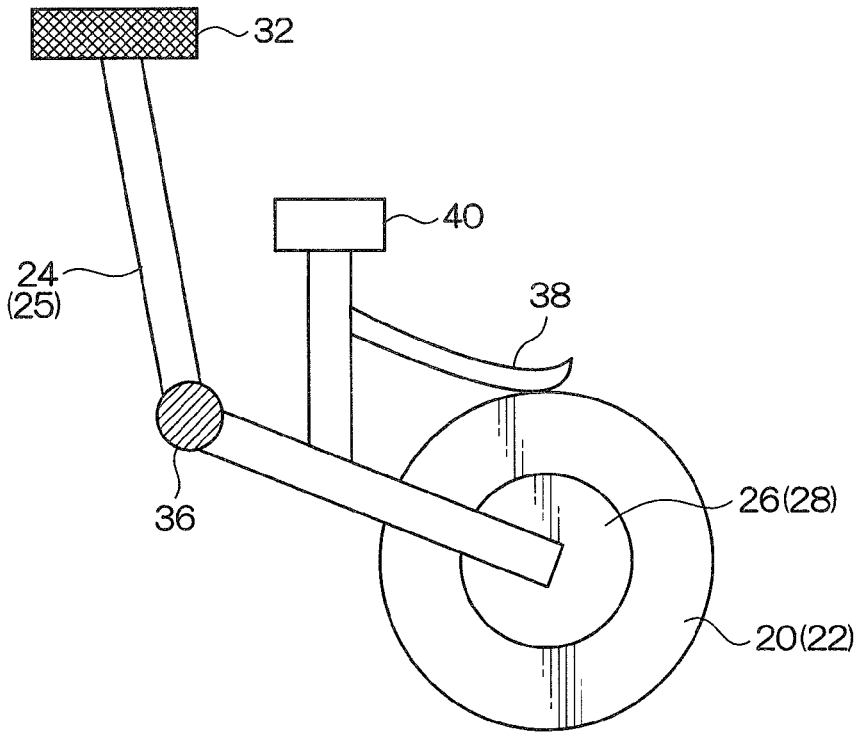

As illustrated in FIG. 7B, when the rotating electrode 20 is energized by elastic force in the direction of the outer peripheral surface of the endless belt 100 by a plate spring 38 provided on the holder 24 and the rotating electrode 20 is energized toward the outer peripheral surface of the endless belt 100 by load applied by a given weight 40, the rotating electrode 20 vibrates following the shape of the surface of the endless belt 100, which is a member to be measured, whereby the contact pressure to the endless belt 100 becomes constant.

Similarly to the rotating electrode 20, although illustration is omitted, when the rotating electrode 22 is energized by elastic force in the direction of the position where the endless belt 100 is provided by a flat spring provided on the holder 25 and also the rotating electrode 22 is moved toward the outer peripheral surface of the endless belt 100 by load applied by a given weight, the rotating electrode 22 vibrates following the shape of the surface of the endless belt 100, which is a member to be measured, whereby the contact pressure to the endless belt 100 becomes constant.

The rotating electrodes 22 and 20 may have a diameter of from about 10 mm to about 12 mm and may have a length in the width direction of the outer peripheral surface of from about 3 mm to about 5 mm, and may be formed of stainless steel (SUS440). The rotating electrodes 22 and 20 may be one that is formed of metal (stainless steel) and used in a high accuracy bearing, and are not limited to the above material or dimension.

When measuring the surface resistivity, the resolution of the surface resistivity is determined by the distance between the rotating electrodes 22 and 20. Therefore, it is preferable that the distance between the electrodes is small, although the rotating electrodes 22 and 20 may be apart from each other as long as an area between the rotating electrodes 22 and 20 is within a detection region A to be measured. The distance may be adjusted as appropriate according to the detection region 101A to be measured.

The rotating electrodes 20 and 22 are electrically connected to the surface resistivity measurement unit 46. The surface resistivity measurement unit 46 contains a DC power source for supplying a voltage between the rotating electrodes 20 and 22 (not illustrated), an ammeter 46A for measuring the current value of current flowing between the rotating electrodes 20 and 22 when a voltage is applied between the rotating electrodes 20 and 22, and a calculation unit (not illustrated) for calculating the surface resistivity based on the measurement results of the ammeter.

When the surface resistivity of the endless belt 100 is measured by the surface resistivity measurement unit 46, the detecting device 134 detects the detection region 101A on the endless belt 100. Specifically, information indicating the surface resistivity of the detection region 101A is stored (memorized) in advance, and the surface resistivity of the rotated endless belt 100 is measured by the surface resistivity measurement unit 46. Then, when a surface resistivity is measured which matches the previously-stored information indicating the surface resistivity of the detection region 101A, it may be determined that the detection region 101A has been detected.

The detection method of the detection region 101A is not limited to this method. The detection region 101A on the endless belt 100 may be detected by measuring the surface resistivity of the rotated endless belt 100, and detecting the time for the surface resistivity to return to a high state after changing from the high state to a low state.

The voltage value of the voltage applied between the rotating electrodes 20 and 22 by the surface resistivity measurement unit 46 may be a voltage value that causes changes in the surface resistivity allowing the detection of the detection region 101A (namely, a voltage value that causes difference in the surface resistivity between the detection region 101A and the non-detection region 101B). Therefore, the voltage value of the voltage applied between the rotating electrodes 20 and 22 may be specified as appropriate according to the surface resistivity of each of the detection region 101A and the non-detection region 101B in the endless belt 100 to be measured and the difference in the surface resistivity. As higher the surface resistivity of the detection region 101A and the non-detection region 101B is, the higher the voltage to be applied between the rotating electrodes 20 and 22 may be made.

Specifically, when the surface resistivity value of the detection region 101A and the non-detection region 101B is about $10^{14}\Omega$, the voltage to be applied between the rotating electrodes 20 and 22 may be in the range of about 100 V to about 1000 V, and preferably in the range of about 100V to about 750V, so as to apply a large amount of measurement current. In this case, when the voltage value of the voltage to be applied between the rotating electrodes 20 and 22 is lower than about 100 V, the measurement current may become low, and noise influence may increase. When the voltage value is larger than about 1000 V, the phenomenon of electrical discharge from the electrodes may occur.

In the cartridge 130 having this configuration, the driving roll 132 is rotated in the circumferential direction by actuation of a driving unit (not illustrated), and the follower roll 131 is rotated in the circumferential direction following the rotation of the driving roll 132, whereby the endless belt 100 tensioned by the follower roll 131 and driving roll 132 is rotated in the circumferential direction (direction indicated by the arrow Z in FIG. 5). Then, the detection regions 101A provided in the outer peripheral surface of the endless belt 100 are successively detected by the detecting device 134 by the rotation of the endless belt 100.

Image Forming Apparatus

An image forming apparatus according to one exemplary embodiment of one aspect of the invention has at least: an image holding unit; a charging unit that charges a surface of the image holding unit; a latent image forming unit that forms a latent image on a surface of the image holding unit; a developing unit that develops the latent image into a toner image; a transfer unit that transfers the toner image to a recording medium; and a fixing unit that fixes the toner image onto the recording medium. At least one of the image holding unit, the transfer unit, or the fixing unit has the configuration of the endless belt 100.

The charging unit, the developing unit, and the fixing unit respectively have a configuration containing the endless belt 100 as an annular body.

Herein, explanation is given for an exemplary embodiment in which the endless belt 100 is employed as the transfer unit, which may be also referred to as an intermediate transfer belt.

Figure 8:
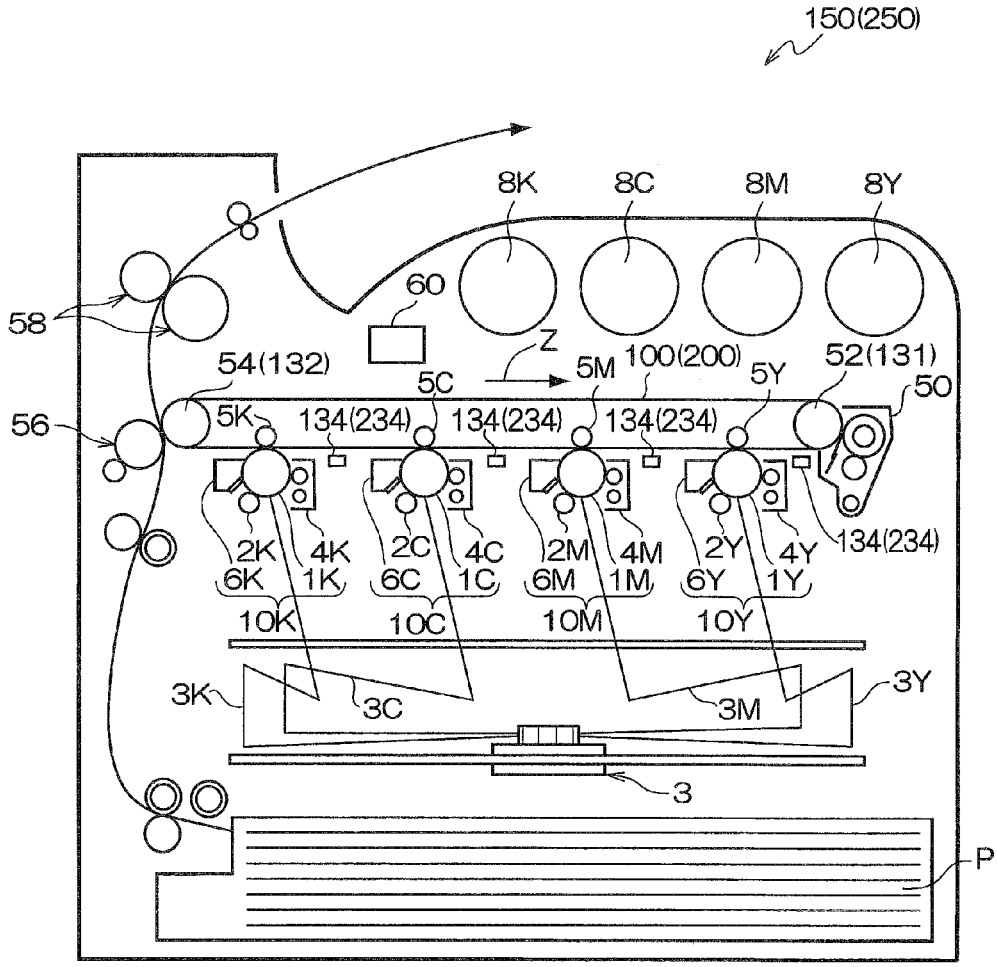
FIG. 8 is a schematic view illustrating an example of an image forming apparatus according to one exemplary embodiment of one aspect of the invention of the invention.

As shown in FIG. 8, the image forming apparatus 150 is provided with first to fourth image forming units (image forming means) 10Y, 10M, 10C, and 10K of an electrophotographic system for outputting an image of each color of yellow (Y), magenta (M), cyan (C) and black (K) based on color-separated image data.

The units 10Y, 10M, 10C, and 10K are horizontally arranged with a certain space therebetween. The units 10Y, 10M, 10C and 10K may be process cartridges attachable to and detachable from the main body of the image forming apparatus.

Above the respective units 10Y, 10M, 10C and 10K in the Figure, the endless belt 100 is arranged as a transfer body (that may be also referred to as an intermediate transfer belt) through the respective units. The endless belt 100 is arranged by being wound around a driving roll 54 and a follower roll 52 in contact with the inner surface of the endless belt 100, and the endless belt 100 runs in the direction of from the first unit 10Y to the fourth unit 10K so as to form a cartridge for the image forming apparatus. Herein, the driving roll 54 functions as the driving roll 132 in the cartridge 130, and a follower roll 52 functions as the follower roll 131 in the cartridge 130.

The driving roll 54 is biased with a spring or the like (not shown) so as to be apart from the follower roll 52, and a tension is applied to the endless belt 100 wound between the two rolls. An intermediate transfer body cleaning device 50 is provided at a side of an image holding unit of the endless belt 100 so as to be opposite to the driving roll 54.

Toners of yellow, magenta, cyan, or black-colored and held in toner cartridges 8Y, 8M, 8C or 8K are respectively supplied to developing device (developing units) 4Y, 4M, 4C or 4K for the respective units 10Y, 10M, 10C and 10K.

Each of the first to fourth units 10Y, 10M, 10C and 10K has a configuration similar to one another. Accordingly, only the first unit 10Y forming a yellow image, arranged on the upstream side of the endless belt 100, is herein explained. Explanations of the second to fifth units 10M, 10C and 10K are omitted by assigning reference marks given magenta (M), cyan (C) and black (K) in place of yellow (Y) given to the equivalent part of the first unit 10Y.

The first unit 10Y has an image holding unit 1Y which works as an image holding member. A charging roll 2Y, an exposure device 3 (a latent image forming exposure unit), a development device 4Y (developing unit), a primary transfer roll 5Y (transfer unit) and a photoreceptor cleaning device 6Y (cleaning unit) are sequentially provided around the image holding unit 1Y. The charging roll 2Y electrically charges the surface of the image holding unit 1Y. The exposure device 3 exposes the charged surface to laser light 3Y according to color-separated image signals to form an electrostatic latent image. The development device 4Y develops the electrostatic latent image by feeding a charged toner contained in the developer to the electrostatic latent image. The primary transfer roll 5Y transfers the resultant toner image onto the endless belt 100. The photoreceptor cleaning device 6Y removes a toner remaining on the surface of the image holding unit 1Y after primary transfer.

The primary transfer roll 5Y is arranged in the inside of the endless belt 100 and arranged in a position opposite to the image holding unit 1Y. A bias power source (not shown) for applying primary transfer bias is electrically connected to each of the primary transfer rollers 5Y, 5M, 5C and 5K. Each bias power source may be controlled by controller (not shown) to change the transfer bias applied to each primary transfer roller.

Hereinafter, an operation of forming a yellow image in the first unit 10Y is described. First, the surface of the image holding unit 1Y is charged at a potential of about −600 V to about −800V with a charging roll 2Y prior to operation (charging).

The image holding unit 1Y is formed by disposing a photosensitive layer on an electroconductive substrate having a volume resistivity at 20° C.: $1\times10^{-6}$ Ωcm or less. This photosensitive layer is usually highly resistant (with approximately the same resistance as that of general resin), but upon irradiation with laser ray 3Y, changes the specific resistance of the portion irradiated with the laser ray. According to image data for black sent from the controller (not shown), the layer ray 3Y is outputted from the exposure device 3 onto the surface of the charged image holding unit 1Y. The photosensitive layer as the surface portion of the image holding unit 1Y is irradiated with the laser ray 3K, whereby an electrostatic latent image in a yellow print pattern is formed on the surface of the image holding unit 1Y (electrostatic latent image forming).

An electrostatic latent image is an image formed on the surface of the image holding unit 1Y by charging. The electrostatic latent is a negative latent image that is obtained by causing the electrification charge of the surface of the image holding unit 1Y to flow due to a reduction in the specific resistance of the irradiated portion of the photosensitive layer, while charge remains on the portion not irradiated with laser ray 3Y. The electrostatic latent image thus formed on the image holding unit 1Y is rotated to a development position with running of the image holding unit 1Y. In this development position, the electrostatic latent image on the image holding unit 1Y is visualized (developed) with the development device 4Y (developing).

The yellow toner is accommodated in the development device 4Y. The yellow toner is stirred in the inside of the development device 4Y and thereby frictionally charged and retained on a developer roll (developer-holding member) and has the same polarity (negative polarity) as that of electrification charge on the image holding unit 1Y. Then, the surface of the image holding unit 1Y passes through the development device 4Y, thereby allowing the yellow toner to electrostatically adhere to the electrically neutralized latent image portion on the surface of the image holding unit 1Y, and thus developing the latent image with the yellow toner. The image holding unit 1Y having the resultant yellow toner image formed thereon is subsequently delivered, and the toner image developed on the image holding unit 1Y is sent to a primary transfer position.

When the black toner image on the image holding unit 1Y reaches the primary transfer position, a primary transfer bias is applied to the primary transfer roll 5Y, and electrostatic force from the image holding unit 1Y to the primary transfer roll 5Y acts on the toner image, and the toner image on the image holding unit 1Y is transferred onto the endless belt 100. The transfer bias to be applied has polarity (+) reverse to the polarity of the toner (−), and for example, the transfer bias in the fourth unit 10Y is regulated at about +10 μA by the controller (not shown). On the other hand, the toner remaining on the image holding unit 1Y is removed and recovered by a cleaning device 6Y.

The primary transfer bias applied to primary transfer rollers 5M, 5C and 5K after second unit 10M is also controlled in the same manner as in the first unit.

The endless belt 100 having the yellow toner image transferred thereon in the first unit 10Y is delivered through the second to fourth units 10M, 10C and 10K in this order, whereby plural color toner images are transferred in a layered state.

The endless belt 100 having four color toner images transferred thereon through the first to fourth units reaches a secondary transfer part composed of the endless belt 100, the support roll 52 in contact with the inner surface of the endless belt 100, and a secondary transfer roll 56 (secondary transfer unit) arranged in the side of the image-holding surface of the endless belt 100. On one hand, a recording paper P (recording medium) is fed via a feeding mechanism with specified time into a gap between the secondary transfer roll 56 and the endless belt 100 that are contacted with each other with pressure, and a secondary transfer bias is applied to the driving roll 54. The transfer bias to be applied has the same polarity (−) as the polarity of the toner (−), and electrostatic force from the endless belt 100 to the recording paper P acts on the toner image, and the toner image on the endless belt 100 is transferred onto the recording paper P (transferring). The secondary transfer bias is determined depending on resistance detected by a resistance detecting device (not shown) for detecting the resistance of the secondary transfer part and is voltage-controlled.

Thereafter, the recording paper P is sent to a fixing device 58 (fixing unit) where the multiple color toner image is heated, and the multiple color toner image is coalesced and fixed on the recording paper P (fixing). After completion of the fixation of the color image, the recording paper P is delivered toward an ejection portion to finish a series of the color-image forming operations.

While the image formation apparatus 150 of the exemplary embodiment has a configuration of transferring a toner image via the endless belt 100 to the recording paper P, the configuration of the image formation apparatus is not restricted only thereto, and it may have a structure in which the toner image is directly transferred from a photoreceptor to the recording paper.

The image forming apparatus 150 having this configuration is provided with a controller 60 for controlling each unit of the device. The controller 60 is connected to each unit of the device so as to be able to send and/or accept a signal. Specifically, the controller 60 is connected to the first to fourth units 10Y, 10M, 10C, and 10K, the exposure device 3, and various appliances disposed in each unit of the device so as to be able to send and/or accept a signal. By the control of the controller 60, the toner images of respective colors are successively multi-transferred on the outer peripheral surface of the endless belt 100 by the exposure device 3 and the first to fourth units 10Y, 10M, 10C, and 10K, and finally a color image is formed on the recording medium P.

In the image forming apparatus 150 of this exemplary embodiment, the detecting device 134 (detecting unit) is provided between each unit of the first to fourth units 10Y, 10M, 10C, and 10K. The detecting devices 134 are connected to the controller 60 so as to be able to send and/or accept a signal. The detecting devices 134 are provided at the position at which the detecting devices 134 can detect the detection region 101A provided in the endless belt 100.

In this exemplary embodiment, the description is given to the case where each of the detecting devices 134 is used for adjusting the time for transferring the toner images to the endless belt 100 in the unit provided adjacent to the downstream side of the rotation direction (direction indicated by the arrow Z in FIG. 8) of the endless belt 100.

The detection region 101A of the endless belt 100 of this exemplary embodiment is a region having a surface resistivity different from that of the non-detection region 101B by providing the high density region 111B inside thereof. Therefore, the detection region 101A is integrally provided with the endless belt 100.

The image forming apparatus 150 of this exemplary embodiment illustrated in FIG. 8 is exemplified to show the case where the endless belt 100 is used for the transfer body, although the application of the endless belt 100 is not limited thereto. Further improvement in image quality may be achieved in the image forming device by detecting the detection region 101A with favorable accuracy over a long period of time by measuring the surface resistivity of the annular bodies to which the endless belt 100 is applied while using the endless belt 100 as various annular bodies of the image forming device and using the same for controlling times for various operations.

In this exemplary embodiment, the image forming device forms the toner image on the intermediate transfer belt (endless belt 100), and then the toner image is transferred to the recording medium P is described. Alternatively, the image forming device may have a configuration in which an image is formed by directly transferring the toner images from an image holding unit to the recording medium P conveyed by using the intermediate transfer belt as a conveying belt, and then fixing the toner images. In this case, when the endless belt 100 is used as the conveying belt, deterioration of image quality may be effectively suppressed.

Second Exemplary Embodiment

In the first exemplary embodiment, the mode where the endless belt 100 has the resin layer 101 containing the resin and the conductive particles 112 is described. In this exemplary embodiment, a mode in which magnetic particles 212 having magnetic property are used in place of the conductive particles 112 will be described.

The expression that "a material has magnetic property" means that the material has properties of generating magnetism by applying a magnetic field, and may be either paramagnetic property or ferromagnetic property.

The magnetic particle 212 is not particularly limited as long as it has magnetic property. The magnetic particle 212 may have conductivity together with magnetic property. The definition of conductivity is explained in the description of the first exemplary embodiment.

An endless belt 200 in this exemplary embodiment has the same configuration as the endless belt 100 described in the first exemplary embodiment, except that the magnetic particles 212 having magnetic property are used in place of the conductive particles 112. The same parts are designated by the same reference numerals, and the detailed descriptions therefor are omitted hereinafter.

As illustrated in FIG. 2, the endless belt 200 contains a resin and the magnetic particles 212.

Similarly to the resin layer 101 in the first exemplary embodiment, the resin layer 201 contains a non-detection region 201B and a detection region 201A. As illustrated in FIG. 2, the detection region 201A has a resin region 211A, a high density region 211B, and a rear surface region 211C which are positioned in this order in the thickness direction from the top surface in the thickness direction.

The "surface (of the endless belt 200)" referred in this exemplary embodiment means the surface which is to be subjected to measurement of the magnetic flux density by a detecting device (explained below). The "top surface" means an area of the outermost side of the resin layer 201.

When the magnetic flux density is measured from the inner peripheral surface of the endless belt 200 by a detecting device 234, the "surface" refers to the inner peripheral surface of the endless belt 200. When the magnetic flux density is measured from the outer peripheral surface of the endless belt 200 by the detecting device 234, the "surface" refers to the outer peripheral surface of the endless belt 200. Herein, the explanation of this exemplary embodiment is made with defining the "surface" as the peripheral outer surface of the endless belt 200.

The resin region 211A is an area where substantially no magnetic particles 212 is present, i.e., an area where only a resin is present. The high density region 211B is an area where the density of the magnetic particles 212 is higher than that of the resin region 211A and that of the rear surface region 211C, which are other areas provided along the thickness direction of the detection region 201A, and also higher than that of the non-detection region 201B. Therefore, the high density region 211B is a highly magnetic area, the magnetism of which is higher than that of the resin region 211A and that of the rear surface region 211C, which are areas other than the high density region 211B in the detection region 201A, and higher than that of the non-detection region 201B.

Therefore, the magnetic flux density of the detection region 201A is higher than that of the non-detection region 201B.

The expression of "magnetic flux density of a region is higher" means that an amount of magnetic flux per unit area is larger with respective to external magnetic field having a certain intensity and applied to the region.

In the endless belt 200, the magnetic flux density of the detection region 201A and the magnetic flux density of the non-detection region 201B are different from each other. Therefore, the detection region 201A and the non-detection region 201B are easily detected by measuring the magnetic flux density generated by application of a magnetic field having a certain intensity of the endless belt 200. Thus, the detection region 201A is used to detect a position of a measured portion in the endless belt 200.

The difference between the magnetic flux density of the detection region 201A and the magnetic flux density of the non-detection region 201B is at least one which enables detection of the detection region 201A by the detecting device 234, which is explained below, when a magnetic field having a certain intensity is applied to these areas.

For example, a difference in the magnetic flux density when a magnetic field having a strength of 10 kOe is applied as a predetermined magnetic field is preferably about 25 mT or more, and more preferably about 30 mT or more.

When the difference in the magnetic flux density between the detection region 201A and the non-detection region 201B is in this range, the detection region 201A may be preferably detected by the measurement of the magnetic flux density of the endless belt 200.

In contrast, when the difference in the magnetic flux density between the detection region 201A and the non-detection region 201B is less than about 25 mT, which is the lower limit of this range, the difference in the magnetic flux density between the detection region 201A and the magnetic flux density of the non-detection region 201B may be too small, which may cause erroneous detection of the non-detection region 201B by the detecting device 234.

In this exemplary embodiment, the resin layer 201 of the endless belt 200 has the detection region 201A and the non-detection region 201B, which are at the surface of the resin layer 201 and differ in the magnetic flux density. The detection region 201A has the magnetic flux density lower than that of the non-detection region 201B. The detection region 201A has the resin region 211A where substantially no magnetic particles 212 is present, the high density region 211B, and the rear surface region 211C, which are present in this order from the top surface along the thickness direction.

The detection region 201A of the endless belt 200 of this exemplary embodiment is integrally provided in the endless belt 200.

The conditions of the thickness of the resin region 211A and the positions of the resin region 211A and the high density region 211B in terms of the thickness direction are similar to those of the thickness of the resin region 111A and the positions of the resin region 111A and the high density region 111B in terms of the thickness direction in the first exemplary embodiment respectively, and thus detailed explanations therefor are herein omitted.

Similarly to the resin layer 101 in the first exemplary embodiment, when the resin layer 201 is divided into plural portions having the same surface area, the contents of the magnetic particles 212 in respective portions are the same value. This condition may be achieved by the production method which is the same as that used for producing the resin layer 101. The definition of the expression of "contents of one material in objects are the same value" and "same content" is explained in the description of the first exemplary embodiment.

As is similar to the first exemplary embodiment, the absence or presence of the magnetic particles 212 in the resin region 211A, the high density region 211B, and the rear surface region 211C may be observed by: a method including producing a cross section piece of the belt (a piece of the endless belt 200) by a focused ion beam (FIB), and then observing the cross section piece with a transmission electron microscope to directly observe the absence or presence of the particles; and a method including producing a cross section piece of the belt with a microtome, and then obtaining the height information from an atomic force microscope (AFM) to see the absence or presence of the particles.

Although the endless belt 200 in this exemplary embodiment has a configuration provided with a single layer of the resin layer 201, the configuration of the annular body, which is one aspect of the invention, is not limited thereto. In another exemplary embodiment, the annular body, which is one aspect of the invention, may have a configuration in which other functional layers are provided on the outer peripheral surface or inner peripheral surface of the resin layer 201. In this case, the other functional layers are layers that do not change the difference in the magnetic flux density between the detection region 201A and the non-detection region 201B in the resin layer 201, or layers which allow detection of the difference by the detecting device even when the magnetic flux density is changed by the other functional layers.

In the exemplary embodiment illustrated in FIG. 1, the detection regions 201A are provided at given intervals along the edge of the endless belt 200. The detection region 201A is not required to be provided in the entire of the surface of the resin layer 201. It is sufficient as long as the detection region 201A is provided in a part(s) of the surface of the resin layer 201 according to application purposes. The detection region 201A may be provided at any position of the surface of the resin layer 201. For example, the detection region 201A may be provided at the center in the width direction as illustrated in FIG. 3. Since the detection region 201A is detected by measurement of the magnetic flux density, the place at which the detection region 201A is not specified in the surface of the endless belt 200. In contrast to conventional arts in which the position of the detection region is limited to the peripheral edge or the like, the detection region 201A may be formed at any place in the surface of the endless belt 200.

In this exemplary embodiment, plural detection regions 201A are provided in the surface of the endless belt 200. However, it is sufficient as long as at least one detection region 201A is provided. Plural detection regions 201A may not be necessary.

A portion (area) of the detection region 201A revealing on the surface of the endless belt 200 may have any shape insofar as the shape may be easily detected by a cartridge 230 or an image forming apparatus 250 described below. Examples of the shape include a circular shape and a rectangular shape.

Hereinafter, the components and properties of the endless belt 200 according to this embodiment will be described.

The endless belt 200 has a configuration in which the resin layer 201 is formed into an annular shape, i.e., an endless belt.

The resin material (resin) contained in the resin layer 201 is similar to that contained in the resin layer 101.

A powder having magnetic property is used as the magnetic particle 212 contained in the resin layer 201. The magnetic particle 212 has magnetic property. In embodiments, the magnetic particle 212 may have both properties of magnetic property and conductivity.

Specific examples of a material of the magnetic particle 212 include triiron tetraoxide ($Fe_3O_4$), iron oxide ($Fe_2O_3$), gadolinium oxide, magnetite, maghematite, various ferrites (such as MnZn ferrite, NiZn ferrite, Yfe garnet, GaFe garnet, Ba ferrite, or Sr ferrite), and metals or alloys thereof (such as iron, manganese, cobalt, nickel, chromium, gadolinium, or alloys thereof). These substances may be used singly or in combination. In embodiments, triiron tetraoxide and iron oxide which are paramagnetic substances may be used from the viewpoint of improvement in dispersibility.

The endless belt 200 having the resin layer 201 in this exemplary embodiment may produced in the similar manner as the endless belt 100 having the resin layer 101 in the first exemplary embodiment, except that the magnetic particles 212 having magnetic property are used in place of the conductive particles 112 (see FIG. 4).

Since details of the method for producing the endless belt 200 are similar to those of the method for producing the endless belt 100, only the outline of the method for producing the endless belt 200 is herein described.

In the method for producing the endless belt 200 according to this exemplary embodiment, a coating liquid containing the magnetic particles 212, a resin material, and a solvent is prepared first. Then, as illustrated in FIG. 4A, the coating liquid is applied to a cylindrical metal mold 120 to obtain a coating film 222 formed from the coating liquid.

Next, the coating film 222 applied to the cylindrical metal mold 120 is dried.

Next, as illustrated in FIG. 4B, an elution solvent 124 for eluting the resin material is applied only to a target region 201A', which is to be made into the detection region 201A, in the surface of the dried coating film 222. More specifically, the elution solvent 124 is applied only to the target region 201A', which is to be made into the detection region 201A among all the areas in the surface of the coating film 222, and the elution solvent 124 is not applied to regions other than the target region 201A' (regions 201B' in FIGS. 4A to 4C).

As illustrated in FIG. 4C, the magnetic particles 212 are not eluted in the elution solvent 124. Accordingly, when the resin material is eluted into the side of the elution solvent 124, the density of the magnetic particles 212 in the target region 201A' where the resin material has been eluted out increases as compared with the other regions which reside in the thickness direction of the target region 201A' according to the elution of the resin material. As a result, a localization region 122A, in which the magnetic particles 212 are localized, is formed on the surface of the target region 201A' (a region adjacent to the interface with the elution solvent 124).

Next, as illustrated in FIG. 4D, the elution solvent 124 applied to the target region 201A' of the coating film 222 is dried. The resin material precipitates by the drying of the elution solvent 124. The precipitated resin material forms a laminar structure on the localization region 122A in which the magnetic particles 212 are localized. In this case, the applied elution solvent 124 does not contain the magnetic particles 212. Therefore, the resin region 211A, which does not contain the magnetic particles 212, is formed on the localization region 122A, in which the magnetic particles 212 are localized.

As a result, the detection region 201A, in which the resin region 211A, the high density region 211B, and the rear surface region 211C are provided in this order from the surface, is produced.

On the other hand, in the region 201B', to which the elution solvent 124 has not been applied, the dispersion state of the magnetic particles 212 in the state where the coating film 222 is dried as shown in FIG. 4A is maintained.

The endless belt 200 containing the resin layer 201 having the detection region 201A and the non-detection region 201B, which are two areas different in the magnetic flux density in the surface of the endless belt 200, may be produced through this process.

The endless belt 200 having the resin layer 201 obtained by this process has two areas different in the magnetic flux density in the plane direction of the detection region 201A (having a magnetic flux density larger than that of the non-detection region 201B) and the non-detection region 201B. The detection region 201A has the resin region 211A where the magnetic particles 212 are not present, the high density region 211B, and the rear surface region 211C in this order from the top surface in the thickness direction. The high density region 211B is an area where the density of the magnetic particles 212 is larger than that of the resin region 211A, the rear surface region 211C, and the non-detection region 201B.

The resin layer 201 may be produced by this production method. Thus, when the resin layer 201 is divided into plural portions having the same surface area, the contents of the magnetic particles 212 in respective portions are approximately the same value. Therefore, the resin layer 201 in which the volume resistivity is constant along the circumferential direction may be produced.

On the other hand, the detection region 201A and the non-detection region 201B, which are two kinds of regions which are different in the magnetic flux density, are formed in the surface of the resin layer 201.

Cartridge

A cartridge 230 according to this exemplary embodiment contains the endless belt 200 according to this exemplary embodiment, a detecting device 234, and a follower roll 131 and a driving roll 132 as support units as illustrated in FIG. 5.

The endless belt 200 is held under tension by the follower roll 131 and the driving roll 132 that are disposed facing with each other (hereinafter sometimes referred to as "tensioned"). Then, the driving roll 132 is rotated in the circumferential direction by actuation of a driving unit (not illustrated), and then the follower roll 131 is rotated in the circumferential direction following the rotation of the driving roll 132. Thus, the endless belt 200 tensioned by the follower roll 131 and the driving roll 132 is rotated in the circumferential direction (direction indicated by the arrow Z in FIG. 5).

The detecting device 234 is a device for detecting the detection region 201A provided in the resin layer 201 of the endless belt 200, and is provided at a position at which the detecting device 234 can detect the detection region 201A.

In this exemplary embodiment, the detection region 201A is provided so that the surface of the detection region 201A resides in the outer peripheral surface of the endless belt 200. Namely, the detection region 201A is provided so as to be disposed on the outer peripheral surface of the endless belt 200.

Therefore, the detecting device 234 is provided at a position where the detection regions 101A rotating with the rotation of the endless belt 200 can be successively detected when the endless belt 200 is rotated in the circumferential direction by the rotation of the follower roll 131 and the driving roll 132 (direction indicated by the arrow Z in FIG. 5). Specifically, when the detection region 201A is provided at the end in the axial direction of the endless belt 200 as illustrated in FIG. 5, the detecting device 234 may be provided at a position corresponding to the end in the axial direction. When the detection region 201A is provided at the center in the axial direction of the endless belt 200 as illustrated in FIG. 3, the detecting device 234 (not shown) may be provided at a position corresponding to the center in the axial direction.

Although not illustrated, the detecting device 234 contains: a magnetic field applying device for applying the magnetic field having a certain intensity from the outer peripheral surface of the endless belt 200 toward the inner peripheral surface of the endless belt 200; and a magnetic flux density measurement device for measuring the magnetic flux density of the outer peripheral surface of the endless belt 200 when a magnetic field is applied by the magnetic field applying device.

The "magnetic field having a certain intensity" may be a magnetic field having an intensity which causes changes in the magnetic flux density (difference in the magnetic flux density between the detection region 201A and the non-detection region 201B) so that the detection region 201A can be detected. The strength of the magnetic field applied by the magnetic field applying device may be appropriately specified according to the type of magnetic materials of the magnetic particles 212 in the endless belt 200 to be measured or the density of the magnetic particles 212 in the high density region 211B or the non-detection region 201B in the detection region 201A of the endless belt 200.

The region where a magnetic field is applied by the magnetic field applying device may be adjusted in advance according to the shape of the detection region 201A to be measured, the position where the detection region 201A is formed, the dimension thereof, and the like. Specifically, in embodiments, a magnetic field may be selectively applied to at least the inside of the detection region 201A to be measured (namely, only to the detection region 201A, without including the non-detection region 201B). The region where the magnetic flux density is measured by the magnetic flux density measurement device may be adjusted in advance according to the shape of the detection region 201A to be measured, the position where the detection region 201A is formed, the dimension thereof, and the like. Specifically, in embodiments, only the magnetic flux density in the detection region 201A to be measured, to which a magnetic field has been applied by the magnetic field applying device (namely, only the detection region 201A, without including the non-detection region 201B), can be selectively measured.

When the magnetic flux density of the endless belt 200 generated when magnetic field is applied thereto by the magnetic field applying device is measured by the magnetic flux density measurement device, the detecting device 234 detects the detection region 201A on the endless belt 200. Specifically, information indicating the magnetic flux density of the detection region 201A generated when magnetic field having a certain intensity is applied thereto is stored (memorized) in advance, and the magnetic flux density of the rotated endless belt 200 generated when magnetic field is applied thereto by the magnetic field applying device is measured by the magnetic flux density measurement device. Then, when a magnetic flux density is measured which exceeds the previously-stored information indicating the magnetic flux density of the detection region 201A, it may be determined that the detection region 201A has been detected.

The detection method of the detection region 201A is not limited to this method. The detection region 201A on the endless belt 200 may be detected by measuring the magnetic flux density of the rotated endless belt 200, and detecting the time for the magnetic flux density to return to a smaller state after changing from the small state to a large state.

In the cartridge 230 having this configuration, the driving roll 132 is rotated in the circumferential direction by actuation of a driving unit (not illustrated), and the follower roll 131 is rotated in the circumferential direction following the rotation of the driving roll 132, whereby the endless belt 200 tensioned by the follower roll 131 and driving roll 132 is rotated in the circumferential direction (direction indicated by the arrow Z in FIG. 5). Then, the detection regions 201A provided in the outer peripheral surface of the endless belt 200 are successively detected by the detecting device 234 by the rotation of the endless belt 200.

Image Forming Apparatus

An image forming apparatus according to one exemplary embodiment of one aspect of the invention has at least: an image holding unit; a charging unit that charges a surface of the image holding unit; a latent image forming unit that forms a latent image on a surface of the image holding unit; a developing unit that develops the latent image into a toner image; a transfer body that receives the toner image transferred to the transfer body; a transfer unit that transfers the toner image to a recording medium; and a fixing unit that fixes the toner image onto the recording medium. At least one of the image holding unit, the transfer unit, or the fixing unit has the configuration of the endless belt 200.

The charging unit, the developing unit, and the fixing unit respectively have a configuration containing the endless belt 200 as an annular body.

Herein, explanation is given for an exemplary embodiment in which the endless belt 200 is employed as the transfer unit, which may be also referred to as an intermediate transfer belt.

As shown in FIG. 8, the image forming apparatus 250 is provided with first to fourth image forming units (image forming means) 10Y, 10M, 10C, and 10K. Above the respective units 10Y, 10M, 10C and 10K in the Figure, the endless belt 200 is arranged as a transfer body (that may be also referred to as an intermediate transfer belt) through the respective units. The endless belt 200 is arranged by being wound around a driving roll 54 and a follower roll 52 in contact with the inner surface of the endless belt 200, and the endless belt 200 runs in the direction of from the first unit 10Y to the fourth unit 10K so as to form a cartridge for the image forming apparatus. Herein, the driving roll 54 functions as the driving roll 132 in the cartridge 230, and a follower roll 52 functions as the follower roll 131 in the cartridge 230. The image forming apparatus 250 is further provided with a fixing device 58 (fixing unit), and a controller 60 for controlling each unit of the device.

The detecting device 234 (detecting unit) is provided between each unit of the first to fourth units 10Y, 10M, 10C, and 10K. The detecting devices 234 are connected to the controller 60 so as to be able to send and/or accept a signal. The detecting devices 234 are provided at the position at which the detecting devices 234 can detect the detection region 201A provided in the endless belt 200.

In this exemplary embodiment, the description is given to the case where each of the detecting devices 234 is used for adjusting the timing for transferring the toner images to the endless belt 200 in the unit provided adjacent to the downstream side of the rotation direction (direction indicated by the arrow Z in FIG. 8) of the endless belt 200.

The image forming apparatus 250 has the same configuration as the image forming apparatus 150 in the first exemplary embodiment, except that the endless belt 200 is used in place of the endless belt 100, and the detecting device 234 is used in place of the detecting device 134. The same parts are designated by the same reference numerals, and the detailed descriptions therefor are omitted hereinafter.

The detection region 201A of the endless belt 200 of this exemplary embodiment is a region having a magnetic flux density different from that of the non-detection region 201B by providing the high density region 211B inside thereof. Therefore, the detection region 201A is integrally provided with the endless belt 200.

The image forming apparatus 250 of this exemplary embodiment illustrated in FIG. 8 is exemplified to show the case where the endless belt 200 is used for the transfer body, although the application of the endless belt 200 is not limited thereto. In embodiments, various annular bodies of the image forming apparatus may be respectively the endless belt 200.

In this exemplary embodiment, the image forming apparatus forms the toner image on the intermediate transfer belt (endless belt 200), and then the toner image is transferred to the recording medium P is described. Alternatively, the image forming apparatus may have a configuration in which an image is formed by directly transferring the toner images from an image holding unit to the recording medium P conveyed by using the intermediate transfer belt as a conveying belt, and then fixing the toner images.

In the first exemplary embodiment, the endless belt 100 has a configuration in which the resin layer 101 contains the resin and the conductive particle 112. The surface of the endless belt 100 includes the non-detection region 101B and the detection region 101A. The detection region 101A is detected by the detecting device 134 which measures the surface resistivity of the endless belt 100.

In the second exemplary embodiment, the endless belt 200 has a configuration in which the resin layer 201 contains the resin and the conductive particle 212. The surface of the endless belt 200 includes the non-detection region 201B and the detection region 201A. The detection region 201A is detected by the detecting device 234 which measures the magnetic flux density of the endless belt 200.

When a particles having conductivity as well as magnetic property is used as the magnetic particle 212 contained in the resin layer 201 in the second exemplary embodiment, the detection region 201A may be detected by using the detecting device 134 employed in the first exemplary embodiment. The use of the particle having both of magnetic property and conductivity as the magnetic particle 212 may increase alternatives of the detection method, since the detection region 201A of the resin layer 201 containing such particle may be detected by any of the detecting device 134, which measures the surface resistivity as described in the first exemplary embodiment, and the detecting device 234, which measures the magnetic flux density as described in the second exemplary embodiment.

Specific examples of the particle having both of magnetic property and conductivity include a magnetite particle.

The resin layer 101 is explained in the first exemplary embodiment as containing the conductive particles 112, and the resin layer 201 is explained in the second exemplary embodiment as containing the magnetic particle 212. In embodiments, the particles contained in the resin layer 101 is not limited to only the conductive particles 112, and the particles contained in the resin layer 201 is not limited to only the magnetic particle 212. In embodiments, the particles contained in the resin layer 101 and the particles contained in the resin layer 201 may be a mixture of the conductive particles 112 and the magnetic particle 212.

The use of the mixture of the conductive particles 112 and the magnetic particle 212 in the resin layer 101 may increase alternatives of the detection method, since the detection region 101A of the resin layer 101 containing such mixture may be detected by any of the detecting device 134, which measures the surface resistivity as described in the first exemplary embodiment, and the detecting device 234, which measures the magnetic flux density as described in the second exemplary embodiment.

Similarly, the use of the mixture of the conductive particles 112 and the magnetic particle 212 in the resin layer 201 may increase alternatives of the detection method, since the detection region 201A of the resin layer 201 containing such mixture may be detected by any of the detecting device 134, which measures the surface resistivity as described in the first exemplary embodiment, and the detecting device 234, which measures the magnetic flux density as described in the second exemplary embodiment.

When the resin layer 101 contains a mixture of both of the conductive particles 112 and the magnetic particle 212, and the detection region 101A is detected by the detecting device 134 by measuring the surface resistivity, the content of the conductive particles 112 and/or the magnetic particle 212 having conductivity which is/are contained in the resin layer 101, the components of the particles, the density of the particles that are localized in the high density region, and the like may be adjusted in advance so that the change in the surface resistivity (differences in the surface resistivity between the detection region 101A and the non-detection region 101B) becomes sufficient to detect the detection region 101A.

When the resin layer 101 contains a mixture of both of the conductive particles 112 and the magnetic particle 212, and the detection region 101A is detected by the detecting device 234 by measuring the magnetic flux density, the content of the magnetic particles 212 which is contained in the resin layer 101, the components of the particles, the density of the particles that are localized in the high density region, and the like may be adjusted in advance so that the change in the magnetic flux density (differences in the magnetic flux density between the detection region 101A and the non-detection region 101B) becomes sufficient to detect the detection region 101A.

When the resin layer 201 contains a mixture of both of the conductive particles 112 and the magnetic particle 212, and the detection region 201A is detected by the detecting device 134 by measuring the surface resistivity, the content of the conductive particles 112 and/or the magnetic particle 212 having conductivity which is/are contained in the resin layer 201, the components of the particles, the density of the particles that are localized in the high density region, and the like may be adjusted in advance so that the change in the surface resistivity (differences in the surface resistivity between the detection region 201A and the non-detection region 201B) becomes sufficient to detect the detection region 201A.

When the resin layer 201 contains a mixture of both of the conductive particles 112 and the magnetic particle 212, and the detection region 201A is detected by the detecting device 234 by measuring the magnetic flux density, the content of the magnetic particles 212 which is contained in the resin layer 201, the components of the particles, the density of the particles that are localized in the high density region, and the like may be adjusted in advance so that the change in the magnetic flux density (differences in the magnetic flux density between the detection region 201A and the non-detection region 201B) becomes sufficient to detect the detection region 201A.

When the resin layer 101 or the resin layer 201 contains a mixture of both of the conductive particles 112 and the magnetic particle 212, and the detection region 101A or the detection region 201A is made as being detectable by both of the detecting device 134 and the detecting device 234, the content of the conductive particles 112 and/or the content of the magnetic particles 212 which is/are contained in the resin layer 101 or the resin layer 201, the components of the particles, the density of the particles that are localized in the high density region, and the like may be adjusted in advance so that the change in the surface resistivity becomes sufficient to detect the detection region 101A as well as the change in the magnetic flux density becomes sufficient to detect the detection region 201A.

EXAMPLES

Hereinafter, the exemplary embodiment is explained with referring to the Examples, although the invention is not limited thereto.

The measurements of the surface resistivity and the magnetic flux density are carried out as follows.

Figure 9A:
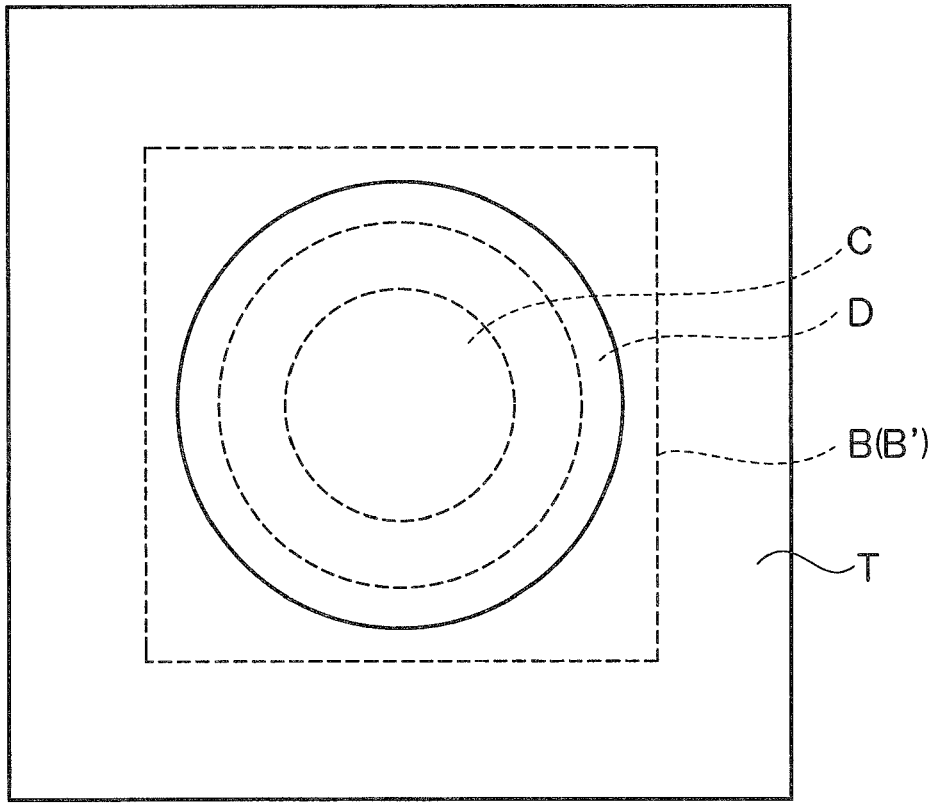
FIG. 9A is a schematic plan view illustrating an example of the circular electrode.
Figure 9B:
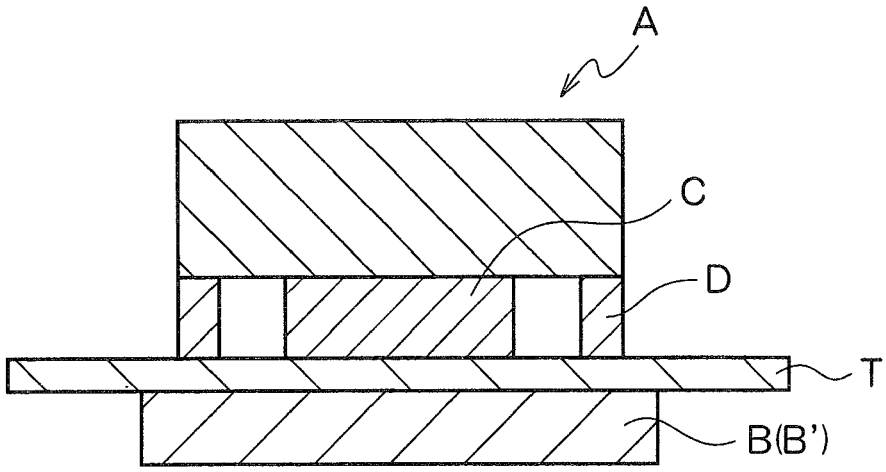
FIG. 9B is a schematic cross sectional view illustrating the example of the circular electrode shown in FIG. 9A.

The measurement of the surface resistivity is carried out using a circular electrode (for example, "UR PROBE" of HIRESTER IP (trade name, manufactured by Mitsubishi Petrochemical Co., Ltd.)) according to JIS K6911, the disclosure of which is incorporated by reference herein. A method for measuring the surface resistivity will be described using the drawings. FIG. 9A is a schematic plan view illustrating an example of the circular electrode, and FIG. 9B is a schematic cross sectional view illustrating this example of the circular electrode. The circular electrode illustrated in FIGS. 9A and 9B has a first voltage application electrode A and a plate shaped insulator B. The first voltage application electrode A has a cylindrical electrode portion C and a ring-shaped electrode portion D. The ring-shaped electrode portion D has a cylindrical shape, has a larger inner diameter than the outer diameter of the cylindrical electrode portion C, and surrounds the cylindrical electrode portion C at a fixed interval. A belt T is placed between the cylindrical electrode portion C and the ring-shaped electrode portion D in the first voltage application electrode A and the plate shaped insulator B, a current I (A) flowing when a voltage V(V) is applied between the cylindrical electrode portion C and the ring-shaped electrode portion D in the first voltage application electrode A is measured, and then the surface resistivity ρs (Ω/□) of the transfer surface of the belt T is calculated according to the following equality. Here, in the following equality, d (mm) represents the outer diameter of the cylindrical electrode portion C, and D (mm) represents the inner diameter of the ring-shaped electrode portion D.

Equality: $\rho s=\pi\times(D+d)/(D-d)\times(V/I)$

The surface resistivity is calculated based on a current value determined under the environment of 22° C./55% RH after the application of a voltage 500 V for 10 seconds using a circular electrode (UR PROBE of HIRESTER IP (described above): the cylindrical electrode portion C has an outer diameter of 16 mm, and the ring-shaped electrode portion D has an inner diameter of 30 mm and an outer diameter of 40 mm).

The measurement of the volume resistivity is carried out using a circular electrode (for example, "UR PROBE" of HIRESTER IP (trade name, manufactured by Mitsubishi Petrochemical Co., Ltd.)) according to JIS K6911, the disclosure of which is incorporated by reference herein. The measurement of the volume resistivity is carried out using the same apparatus as that employed in the measurement of the surface resistivity, except that a second voltage application electrode B' is employed in place of the plate shaped insulator B used in the measurement of the surface resistivity. A belt T is placed between the cylindrical electrode portion C and the ring-shaped electrode portion D in the first voltage application electrode A and the second voltage application electrode B', a current I(A) flowing when a voltage V(V) is applied between the cylindrical electrode portion C in the first voltage application electrode A and the second voltage application electrode B' is measured, and then the volume resistivity ρv (Ωcm) of the belt T is calculated according to the following equality. Here, in the following equality, t represents the thickness of the belt T.

Equality: $\rho s = 19.6 \times (V/I) \times t$

The volume resistivity is calculated based on a current value determined under the environment of 22° C./55% RH after the application of a voltage 500 V for 10 seconds using a circular electrode (UR PROBE of HIRESTER IP (described above): the cylindrical electrode portion C has an outer diameter of 16 mm, and the ring-shaped electrode portion D has an inner diameter of 30 mm and an outer diameter of 40 mm).

In the equality above, 19.6 is an electrode coefficient for converting the calculated value into resistivity, and provides a calculation result having a dimension of $\pi d^2/4t$ from the outer diameter d (mm) of the cylindrical electrode portion and the thickness t (cm) of a sample. The thickness of the belt T is measured using an eddy-current film thickness meter CTR-1500E (trade name, manufactured by Sanko Electronics).

The magnetic flux density is determined by measuring the magnetic flux density in a target region when a magnetic field of 10 kOe is applied to the target region. In detail, the magnetic flux density is determined by preparing an electromagnet WS24-40SV-5K-N1 (trade name, manufactured by Hayama Inc.) as a magnetic field applying device, and measuring, while applying the magnetic field of 10 kOe to the target region by the magnetic field applying device, the magnetic flux density of the target region (the non-detection region and the detection region on the outer peripheral surface of the endless belt in the following Examples and Comparative Examples) by using a Hall element HW-101A (trade name, manufactured by Asahi Kasei Corporation) for a switching circuit.

Example 1

Production of Endless Belt A1

Preparation of Coating Liquid (Polyimide Precursor Solution)

Dried oxidized carbon black (SPEDIAL BLACK4 (trade name), manufactured by Degussa) is added to a polyamic acid N-methyl-2-pyrrolidone (NMP) solution (U-Varnish RS (trade name), manufactured by Ube Industries) containing biphenyl tetracarboxylic dianhydride (BPDA) and p-phenylenediamine oxydianiline (ODAPDA) so that the addition amount of the dried oxidized carbon black becomes 23 parts by mass with respect to 100 parts by mass of a polyimide resin solid content of the polyamic acid NMP solution. The resultant is subjected to 5 times of a collision dispersing process, in which the resultant is divided to two parts, collided using a collision type disperser having the minimum area of 1.4 $mm^2$ (trade name: GEANUS PY, manufactured by GEANUS) at a pressure of 200 MPa, and further divided to two parts again to be subjected to a next colliding. Then, the resultant is mixed to obtaining a carbon-black-dispersed polyamic acid solution (coating liquid A1) having a viscosity of 150 poise.

Production of Endless Belt A1 Having Detection Region

An aluminum cylindrical base, which has a cylindrical shape having an outer diameter of 190 mm, a length of 600 mm and a 5 mm-thickness mold release agent attached thereto by baking, is prepared as a molding core body. The coating liquid A1 is applied to the outer peripheral surface of the core body while rotating the core body at 100 rpm and while moving a dispenser and a scraper at a rate of 150 min/min so that the application length is 350 mm and the application thickness becomes 0.5 mm. Then, the resultant is dried by heating at 120° C. for 30 minutes while rotating the resultant at 5 rpm.

The resultant is cooled to ambient temperature, and a sheet in which an opening (10 mm×10 mm) is formed at a position which corresponds to a target region for forming a detection region (corresponding to the detection region 101A in FIG. 1) is disposed on the dry film. Then, 10 ml of the NMP solution prepared in Example 1 is dropped in the openings, and dried at ambient temperature for 5 minutes. Then, the sheet is removed. The dry film is calcinated by heating to 300° C. for 2 hours to thereby remove the solvent and carry out imide conversion. Finally, the resultant is cooled to ambient temperature, a polyimide tubular body is separated from the core body, and then cut to have a width of 340 mm. Thus, an endless belt A1 having an outer diameter of 190 mm, a thickness of 80 μm, and a width of 340 mm is prepared. The outer peripheral surface of the thus-formed endless belt A1 has a 10 mm×10 mm detection region.

The surface resistivity of the detection region and that of a non-detection region (equivalent to the non-detection region 101B in FIG. 1), which is a region other than the detection region in the endless belt A1, are measured. The common logarithm value of surface resistivity of the detection regions is 6.5 Log Ω/□, and the common logarithm value of surface resistivity of the non-detection region is 10.5 Log Ω/□. Therefore, a difference in the common logarithm value of surface resistivity between the detection region and the non-detection region is 4.0 Log Ω/□.

When the volume resistivity of the endless belt A1 is measured, the common logarithm value of volume resistivity is 9.7 Log Ω·cm in both the non-detection region and the detection region.

Example 2

Production of Endless Belt A2

Preparation of Coating Liquid

A solvent-soluble polyimide resin (trade name: VYLOMAX HR16NN, manufactured by Toyobo Co., Ltd., having a solid content of 18% by mass and being a solution in a solvent of methyl-2 pyrrolidone, which is the same NNP solution as Example 1) is employed as polyimide resin. Carbon black (trade name: SPEDIAL BLACK4, manufactured by Degussa) is added, as conductive particles, to the polyimide resin so that the addition amount thereof becomes 25 parts by mass based on 100 parts by mass of the resin component. The mixture is dispersed using a disperser in a similar manner as in Example 1, thereby preparing a coating liquid A2.

An aluminum cylindrical base, which has a cylindrical shape having an outer diameter of 168 mm, a length of 600 mm and a 5 mm-thickness mold release agent attached thereto by baking, is prepared as a molding core body. The coating liquid A2 is applied to the outer peripheral surface of the core body while rotating the core body at 100 rpm and while moving a dispenser and a scraper at a rate of 150 min/min so that the application length is 350 mm and the application thickness becomes 0.5 mm. Then, the resultant is dried by heating at 120° C. for 30 minutes while rotating the resultant at 5 rpm.

The resultant is cooled to ambient temperature, and a sheet in which an opening (10 mm×10 mm) is formed at a position which corresponds to a target region for forming a detection region (corresponding to the detection region 101A in FIG. 1) is disposed on the dry film. Then, 10 ml of the NMP solution prepared in Example 1 is dropped in the openings, and dried at ambient temperature for 5 minutes. Then, the sheet is removed. The dry film is calcinated by heating to 300° C. for 2 hours. The resultant is cooled to ambient temperature, a polyimide tubular body is separated from the core body, and then cut to have a width of 340 mm. Thus, an endless belt A2 is prepared.

The surface resistivity of the detection region and that of a non-detection region (equivalent to the non-detection region 101B in FIG. 1), which is a region other than the detection region in the endless belt A2, are measured. The common logarithm value of surface resistivity of the detection regions is 6.7 Log Ω/□, and the common logarithm value of surface resistivity of the non-detection region is 11.3 Log Ω/□. Therefore, a difference in the common logarithm value of surface resistivity between the detection region and the non-detection region is 4.6 Log Ω/□.

When the volume resistivity of the endless belt A2 is measured, the common logarithm value of volume resistivity is 8.1 Log Ω·cm in both the non-detection region and the detection region.

Figure 10:
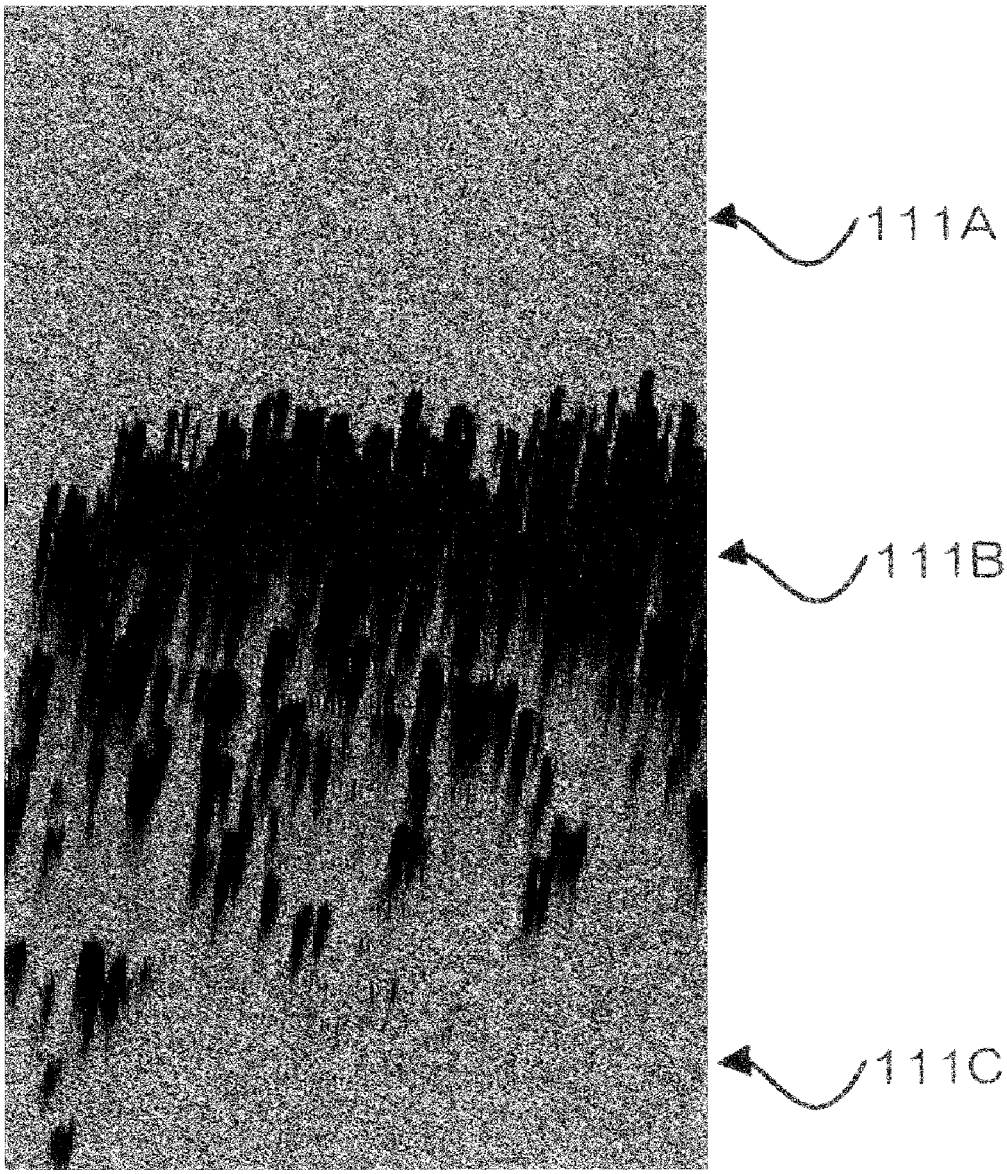
FIG. 10 is a current image of an endless belt produced in Example 2, the current image being obtained using D3000 and NANOSCOPE III (both trade names, manufactured by Digital Instruments).

FIG. 10 is a current image of an endless belt produced in Example 2. The current image is obtained by using D3000 and NANOSCOPE III (both trade names, manufactured by Digital Instruments).

Example 3

Production of Endless Belt A3

Preparation of Coating Liquid A3 (Polyimide Precursor Solution)

A magnetic particle-dispersed polyamic acid solution (coating liquid A3) is prepared in the same manner and under the same conditions as those in the preparation of the coating liquid A1 (polyimide precursor solution) in Example 1, except that 23 parts by mass of triiron tetraoxide ($Fe_3O_4$) is used in place of 23 parts by mass of the dry oxidized carbon black (SPEDIAL BLACK4, described above) used in Example 1.

An endless belt A3 having an outer diameter of 190 mm, a thickness of 80 μm, and a width of 340 mm is prepared in the same manner as the endless belt A1, except that the coating liquid A3 is used in place of the coating liquid A1 used in Example 1. The outer peripheral surface of the thus-formed endless belt A3 has a 10 mm×10 mm detection region, which corresponds to the detection region 201A in FIG. 1.

The magnetic flux density of the detection region and that of a non-detection region (equivalent to the non-detection region 201B in FIG. 1), which is a region other than the detection region in the endless belt A3, are measured. The magnetic flux density of the detection regions is 50 mT, and the magnetic flux density of the non-detection region is 20 mT. Therefore, a difference in the magnetic flux density between the detection region and the non-detection region is 30 mT.

When the volume resistivity of the endless belt A3 is measured, the common logarithm value of volume resistivity is 12.0 Log Ω·cm in both the non-detection region and the detection region.

Comparative Example 1

A belt-shaped member is produced using the same conditions and the same method as in the endless belt A2 prepared in Example 2, except that the dropping of the NMP solution on a dry film to form the detection region 101A is omitted. An aluminum seal, which functions as a detection region, is attached to an area, which corresponds to the detection region 101A in the endless belt A2 prepared in Example 2, in the belt-shaped member. A comparative endless belt A1 is thus prepared.

The aluminum seal is formed by applying a silicone adhesive to a rear surface of an aluminum sheet (10 mm×10 mm), on which aluminum has been vapor-deposited on a PET film, to have a thickness of 5 μm.

Evaluation

The belts (the endless belts A1 to A3 and the comparative endless belt A1) are respectively subjected to the following evaluation tests. Results thereof are shown in the following Tables 1 to 3.

Evaluations of Accuracy in Position Detection Based on Surface Resistivity or Magnetic Flux Density and Visual Observation of Detection Region Each of the obtained endless belts A1 to A3 and the comparative endless belt A1 is placed, as an intermediate transfer belt, on a modified machine of DOCUCOLOR 450 (trade name, manufactured by Fuji Xerox Co., Ltd.; process speed: 500 mm/sec, primary transfer current: 45 μA, secondary transfer voltage: 3.5 kV), and subjected to a print test under the environment of 10° C./15% RH. The test performs printing on 300000 sheets of A4 size-C2 paper manufactured by Fuji Xerox Co., Ltd.

Whether or not the position of the detection region can be detected from the detection region 101A in the endless belt A1 produced in Example 1 and that of the endless belt A2 produced in Example 2 is evaluated by measuring the surface resistivity of the detection region 101A in the endless belt A1 and that of the endless belt A2. This measurement is carried out at both of before and after the print test.

Whether or not the position of the detection region can be detected from the comparative endless belt A1 produced in Comparative Example 1 is evaluated by reading light reflection from the aluminum seal as the detection region using an optical sensor.

Whether or not the position of the detection region can be detected from the detection region 201A in the endless belt A3 produced in Example 3 is evaluated by measuring the magnetic flux density of the detection region 201A in the endless belt A3. This measurement is carried out at both of before and after the print test.

TABLE 1

| | | Before print test | | | | | |
|---|---|---|---|---|---|---|---|
| | | Detection region or Region corresponding to detection region | | | Non-detection region or Region other than the region corresponding to detection region | | |
| | Belt | Common logarithm value of Surface resistivity (Log Ω/□) | Magnetic flux density (mT) | Common logarithm value of Volume resistivity (LogΩcm) | Common logarithm value of Surface resistivity (LogΩ/□) | Magnetic flux density (mT) | Common logarithm value of Volume resistivity (LogΩcm) |
| Example 1 | Endless belt A1 | 6.5 | — | 9.7 | 10.5 | — | 9.7 |
| Example 2 | Endless belt A2 | 6.7 | — | 8.1 | 11.3 | — | 8.1 |
| Example 3 | Endless belt A3 | — | 50 | 120 | — | 20 | 120 |
| Comp. Example 1 | Comparative endless belt A1 | 11.3 | — | 8.1 | 11.3 | — | 8.1 |

TABLE 2

| | | After print test | | | | | |
|---|---|---|---|---|---|---|---|
| | | Detection region or Region corresponding to detection region | | | Non-detection region or Region other than the region corresponding to detection region | | |
| | Belt | Common logarithm value of Surface resistivity (Log Ω/□) | Magnetic flux density (mT) | Common logarithm value of Surface resistivity (Log Ω/□) | Magnetic flux density (mT) | Common logarithm value of Surface resistivity (Log Ω/□) | Magnetic flux density (mT) |
| Example 1 | Endless belt A1 | 6.5 | — | 9.7 | 10.5 | — | 9.7 |
| Example 2 | Endless belt A2 | 6.7 | — | 8.1 | 11.3 | — | 8.1 |
| Example 3 | Endless belt A3 | — | 50 | 120 | — | 20 | 120 |
| Comp. Example 1 | Comparative endless belt A1 | 11.3 | — | 8.1 | 11.3 | — | 8.1 |

TABLE 3

| | | After print test | | |
|---|---|---|---|---|
| | | | Evaluation of position detection | |
| | Belt | Visual observation of Detection region | Measurement of Surface resistivity | Measurement of Magnetic flux density |
| Example 1 | Endless belt A1 | — | Detected | — |
| Example 2 | Endless belt A2 | — | Detected | — |
| Example 3 | Endless belt A3 | — | — | Detected |
| Comp. Example 1 | Comparative endless belt A1 | Peeling of A1 seal is observed | Undetected | Undetected |

As shown in Tables 1 to 3, no change in the surface resistivity of the detection region between before and after the print test is observed in the endless belt A1 and the endless belt A2 produced in Examples 1 and 2, respectively. Therefore, the detection regions may be detected with favorable accuracy over a long period of time when each detection regions are detected by measuring the surface resistivity of the endless belt A1 and the endless belt A2 produced in Examples 1 and 2, respectively.

As shown in Tables 1 to 3, no change in the magnetic flux density of the detection region between before and after the print test is observed in the endless belt A3 produced in Example 3. Therefore, the detection region may be detected with favorable accuracy over a long period of time when each detection region is detected by measuring the magnetic flux density of the endless belt A3 produced in Example 3.

In contrast, in the comparative endless belt A1 produced in Comparative Example 1, the corner of the aluminum seal begins to be peeled off after about 20,0000 sheet printing, and the aluminum seal is completely peeled off after 25,0000 sheet printing, making position detection impossible.

These results show that the position detection may be carried out with favorable accuracy over the long period of time in Examples 1 to 3 compared with Comparative example 1.

The foregoing description of exemplary embodiments of the present invention has been provided for the purpose of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its applications, thereby enabling others skilled in the art to understand the invention for various embodiments and with the various modifications as are suited to particular use contemplated. It is intended that the scope of the invention be defined by the following claims and their equivalents.

What is claimed is:

1. An endless belt comprising a resin layer, the resin layer comprising a resin and particles, the particles being at least one of conductive or magnetic, a surface of the resin layer comprising a first region and a second region, the first region being different from the second region in at least one of surface resistivity or magnetic flux density, and including a layer in which the particles are dispersed at a surface in the thickness direction of the layer, the second region comprising a resin region and a high density region, the resin region being provided at an outer side with respect to the high density region in the thickness direction of the resin layer and being substantially free of the particles, and the high density region having a higher content of the particles compared to the resin region and the first region.

2. The endless belt of claim 1, wherein volume resistivity of the first region is substantially the same as volume resistivity of the second region.

3. The endless belt of claim 1, wherein the particles are conductive, and the surface resistivity of the second region is smaller than the surface resistivity of the first region.

4. The endless belt of claim 1, wherein the particles are magnetic, and the magnetic flux density of the second region is larger than the magnetic flux density of the first region.

5. A cartridge comprising:

an endless belt including a resin layer, the resin layer including a resin and particles, the particles being at least one of conductive or magnetic, a surface of the resin layer including a first region and a second region, the first region being different from the second region in at least one of surface resistivity or magnetic flux density, the second region including a resin region and a high density region, the resin region being provided at an outer side with respect to the high density region in the thickness direction of the resin layer and being substantially free of the particles, and the high density region having a higher content of the particles compared to the resin region and the first region;

a plurality of support units that hold the endless belt wound around the support units under tension; and a detecting unit that detects the first region by measuring at least one of the surface resistivity or the magnetic flux density of the endless belt.

6. The cartridge of claim 5, wherein volume resistivity of the first region is substantially the same as volume resistivity of the second region.

7. The cartridge of claim 5, wherein the particles are conductive, and the surface resistivity of the second region is smaller than the surface resistivity of the first region.

8. The cartridge of claim 5, wherein the particles are magnetic, and the magnetic flux density of the second region is larger than the magnetic flux density of the first region.

9. An image forming apparatus comprising:

an image holding unit;

a charging unit that charges a surface of the image holding unit;

a latent image forming unit that forms a latent image on a surface of the image holding unit;

a developing unit that develops the latent image into a toner image;

a transfer body that receives the toner image transferred to the transfer body;

a transfer unit that transfers the toner image from the transfer body to a recording medium;

a fixing unit that fixes the toner image onto the recording medium; and a detecting unit for detecting the first region by measuring at least one of the surface resistivity or the magnetic flux density of an endless belt, and at least one of the image holding unit, the charging unit, the developing unit, the transfer unit, or the fixing unit including the endless belt, the endless belt including a resin layer, the resin layer including a resin and particles, the particles being at least one of conductive or magnetic, a surface of the resin layer including a first region and a second region, the first region being different from the second region in at least one of surface resistivity or magnetic flux density, the second region including a resin region and a high density region, the resin region being provided at an outer side with respect to the high density region in the thickness direction of the resin layer and being substantially free of the particles, and the high density region having a higher content of the particles compared to the resin region and the first region.

10. The image forming apparatus of claim 9, wherein volume resistivity of the first region is substantially the same as volume resistivity of the second region.

11. The image forming apparatus of claim 9, wherein the particles are conductive, and the surface resistivity of the second region is smaller than the surface resistivity of the first region.

12. The image forming apparatus of claim 9, wherein the particles are magnetic, and the magnetic flux density of the second region is larger than the magnetic flux density of the first region.

13. An image forming apparatus comprising:

an image holding unit;

a charging unit that charges a surface of the image holding unit;

a latent image forming unit that forms a latent image on a surface of the image holding unit;

a developing unit that develops the latent image into a toner image;

a transfer body that receives the toner image transferred to the transfer body;

a transfer unit that transfers the toner image from the transfer body to a recording medium;

a fixing unit that fixes the toner image onto the recording medium; and at least one of the image holding unit, the charging unit, the developing unit, the transfer unit, or the fixing unit including an endless belt including a resin layer, the resin layer including a resin and particles, the particles being at least one of conductive or magnetic, a surface of the resin layer including a first region and a second region, the first region being different from the second region in at least one of surface resistivity or magnetic flux density, the second region including a resin region and a high density region, the resin region being provided at an outer side with respect to the high density region in the thickness direction of the resin layer and being substantially free of the particles, and the high density region having a higher content of the particles compared to the resin region and the first region.

* * * * *